US006219498B1

(12) United States Patent
Katoh et al.

(10) Patent No.: US 6,219,498 B1
(45) Date of Patent: Apr. 17, 2001

(54) IMAGE FORMING APPARATUS HAVING IMPROVED IMAGE TRANSFER CHARACTERISTICS

(75) Inventors: Atsuyuki Katoh, Tenri; Masaru Tsuji, Nara; Kenji Sugimura, Yamatokoriyama; Yoshiya Kinoshita, Ikoma-gun; Hiroshi Tachiki, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/494,428

(22) Filed: Jan. 31, 2000

Related U.S. Application Data

(62) Division of application No. 09/195,543, filed on Nov. 19, 1998, now Pat. No. 6,044,236.

(30) Foreign Application Priority Data

Nov. 28, 1997 (JP) ..... 9-329044

(51) Int. Cl.[7] ..... G03G 15/00; G03G 15/20
(52) U.S. Cl. ..... 399/45; 399/69; 399/389
(58) Field of Search ..... 399/45, 68, 69, 399/66, 50, 51, 302, 389

(56) References Cited

U.S. PATENT DOCUMENTS

| | | | | |
|---|---|---|---|---|
| 5,204,729 | | 4/1993 | Maeda et al. . | |
| 5,438,398 | | 8/1995 | Tanigawa et al. . | |
| 5,666,599 | * | 9/1997 | Miyasaka et al. | 399/302 X |
| 5,729,808 | | 3/1998 | Bisaiji et al. . | |
| 5,745,255 | * | 4/1998 | Yamaguchi | 399/45 X |
| 5,745,830 | | 4/1998 | Fujiwara et al. . | |
| 5,761,568 | * | 6/1998 | Haragakiuchi et al. | 399/45 X |
| 5,809,373 | | 9/1998 | Yoda et al. . | |
| 5,815,775 | | 9/1998 | Miyasaka et al. . | |

FOREIGN PATENT DOCUMENTS

| | | | |
|---|---|---|---|
| 63-256976 | | 10/1988 | (JP) . |
| 2-193841 | * | 7/1990 | (JP) . |
| 3-55585 | * | 3/1991 | (JP) . |
| 4-066970 | | 3/1992 | (JP) . |
| 5-265300 | | 10/1993 | (JP) . |
| 6-83144 | * | 3/1994 | (JP) . |
| 7-72694 | * | 3/1995 | (JP) . |
| 8-22203 | * | 1/1996 | (JP) . |
| 8-063052 | | 3/1996 | (JP) . |
| 8-220902 | | 8/1996 | (JP) . |
| 9016001 | | 1/1997 | (JP) . |
| 9-96942 | * | 4/1997 | (JP) . |
| 9127805 | | 5/1997 | (JP) . |
| 9146389 | | 6/1997 | (JP) . |
| 9-222823 | | 8/1997 | (JP) . |

* cited by examiner

*Primary Examiner*—Joan Pendegrass

(57) ABSTRACT

By application of a voltage from a power source, a transfer roller carries out both transfers of (A) a first transfer for transferring a toner image on a photoreceptor to an intermediate transfer medium and (B) a second transfer for transferring overlapped color toner image on the intermediate transfer medium at once onto a recording sheet. A transfer voltage in accordance with, for example, a sheet thickness, as detected by sheet type detection of a sheet type detecting section is applied to the transfer roller in each stage. When the sheet type detecting section detects that the recording sheet is longer than a periphery of a fixing belt, a heater lamp is turned on in advance at any instant between a time when the recording sheet is brought into contact with the fixing roller and a time when the fixing roller completes one rotation, taking into consideration a time required for conduction of heat from the heater lamp to the fixing belt. As a result, it is possible to reduce ozone generated and make the device compact, and desirable transfer characteristics in accordance with a sheet type are obtained, thus realizing uniform fixing of an unfixed toner image onto the recording sheet, from the front end to the rear end.

10 Claims, 30 Drawing Sheets

IMAGE FORMING APPARATUS HAVING IMPROVED IMAGE TRANSFER CHARACTERISTICS

This application is a divisional of application Ser. No. 09/195,543, filed on Nov. 19, 1998, now U.S. Pat. No. 6,044,236, the entire contents of which are hereby incorporated by reference.

FIELD OF THE INVENTION

The present invention relates to an image forming apparatus such as a copying machine and a laser printer, and particularly to an image forming apparatus which transfers a color toner image formed on a photoreceptor at once onto a recording medium such as paper via an intermediate transfer medium.

BACKGROUND OF THE INVENTION

Conventionally, a variety of image forming apparatuses such as a copying machine have been proposed. Such image forming apparatuses are roughly divided into two types by a difference in transfer system of a color toner image onto a recording medium. One is an image forming apparatus adopting a so-called direct transfer system in which a recording medium is held by being wrapped around a transfer medium, and a toner image on a photoreceptor is directly transferred onto the recording medium color by color. The other is an image forming apparatus in which a color toner image formed on a photoreceptor is transferred at once onto an intermediate transfer medium, and thereafter transferred onto a recording medium from the intermediate transfer medium.

However, in the former image forming apparatus, there is a case where a desired color image cannot be obtained depending on the type of a recording medium used. This is because of the fact that the transfer characteristics of the toner image are different for different colors depending on the type (especially thickness) of the recording medium used. As a result, in a color toner image composed of overlapping toner images of different colors, the coloring differs among recording media. Thus, in order to obtain a desired color image in this image forming apparatus, it is required to limit the range of thickness, etc., of the recording medium used.

However, in recent years, a demand for color copying for a recording medium of various thicknesses and various paper types has come to a level which cannot be met by the described image forming apparatus. Further, in the above image forming apparatus, because the toner image is transferred to the recording medium color by color, the overlapping accuracy of the toner images is always a problem. However, it has come to a level where the overlapping accuracy cannot be improved any further.

Therefore, it now has been a focus of ongoing research to develop an image forming apparatus provided with an intermediate transfer medium, which is capable of color copying regardless of the type of a recording medium used. As an example of such an image forming apparatus, the image forming apparatus as disclosed in Japanese Unexamined Patent Publication No. 251864/1991 (Tokukaihei 3-251864) is described below. In this image forming apparatus, a copying process is carried out for each of a high density portion and a low density portion of a single document image. As a result, a color toner image obtained by a single copying process is overlapped with another color toner image on the intermediate transfer medium, thus forming a single color toner image.

The above image forming apparatus as a copying machine as disclosed in the above publication is provided with, as shown in FIG. 27, a transparent document plate 101 on an upper surface. Below the document plate 101 is provided an exposure optical system 103 for exposing and scanning a document 102 and exposing a photoreceptor 104 (mentioned later).

The exposure optical system 103 is provided with a light source lamp 103*a* for projecting light onto the document 102 placed on the document plate 101, a plurality of reflecting mirrors 103*b* through 103*f* for guiding, as shown by the alternate short and long line in FIG. 27, the reflected light off the document 102 onto the photoreceptor 104, a focus lens 103*g* provided in the path of the reflected light, and a color separating filter composed of color filters of three primary colors of red, green, and blue.

Underneath the exposure optical system 103 is provided the photoreceptor 104 having a belt shape. The photoreceptor 104 is suspended between two rollers 105 and 106, which are placed with a certain gap therebetween, and the photoreceptor 104 is rotatably driven by a motor (not shown).

Around the photoreceptor 104 on the roller 106 side are provided, along with other members, a static charger 107 for charging the photoreceptor 104, a cleaning device 108 for removing toner remaining on the photoreceptor 104, and a screen filter 109 for splitting the reflected light off the document 102 into rays.

On the upper side of the photoreceptor 104 is provided a developing device 113 having three developer tanks 110 through 112 without contacting the photoreceptor 104. The developer tanks 110 through 112 store color developers of yellow, magenta, and cyan, respectively, which are complementary colors of the three primary colors of the color filters of the color separating filter 103*h*. The developer tanks 110 through 112 are provided with magnet rollers 110*a* through 112*a*, respectively, which give the respective color developers to the photoreceptor 104.

Below the photoreceptor 104 are provided sheet feeding cassettes 114 and 115 on top of the other having different sizes for feeding a recording sheet 130 as a recording medium. On the discharge sides of the sheet feeding cassettes 114 and 115, sheet feeding rollers 116 and 117 are provided, respectively. In front of the sheet feeding cassettes 114 and 115 are provided timing rollers 118 for temporarily stopping the recording sheet 130 so that the recording sheet 130 is supplied at a predetermined timing.

On the roller 105 side of the photoreceptor 104 is provided an intermediate transfer device 119. The intermediate transfer device 119 is composed of, along with other members, the intermediate transfer medium 120 having a belt shape, three rollers 121 through 123 for rotatably driving the intermediate transfer medium 120, a transfer charger 124 for transferring a toner image of each color component on the photoreceptor 104 onto the intermediate transfer medium 120, a transfer charger 125 for transferring a color toner image formed on the intermediate transfer medium 120 onto the recording sheet 130, a separating charger 126 for separating the recording sheet 130 from the intermediate transfer medium 120, and the cleaning device 127 for removing toner remaining on the intermediate transfer medium 120.

In the discharge direction of the intermediate transfer medium 120 are provided a transport belt 128 for transporting the recording sheet 130 and a fixing device 129 for fixing the color toner image onto the recording sheet 130.

When carrying out full-color copying in the described arrangement, first, the screen filter 109 is set aside from the exposure path and the exposure is started with respect to a high density portion.

Specifically, the light source lamp 103*a* projects light onto the document 102 placed on the document plate 101 so as to carry out optical-scan three times. The reflected light off the document 102 is incident on the color separating filter 103*h* via the reflecting mirrors 103*b* through 103*d* and the focus lens 103*g*, and is separated into color components by the color separating filter 103*h*. The reflected light separated into color components is then successively projected, via the reflecting mirrors 103*e* and 103*f*, onto the photoreceptor 104, which has been uniformly charged by the static charger 107, so as to expose the photoreceptor 104. As a result, an electrostatic latent image of each color component, corresponding to the document image is formed on the photoreceptor 104.

The electrostatic latent image of each color is made visible by being developed by the corresponding developers of yellow, magenta, and cyan of the developing device 113, which are complementary colors of the three primary colors of the color filters of the color separating filter 103*h*, and the electrostatic latent image becomes a toner image. Then, in the intermediate transfer device 119, the toner image of each color component is successively transferred onto the intermediate transfer medium 120 by the transfer charger 124 so as to be overlapped. This completes a single color toner image with respect to the high density portion, and a first copying process with respect to the high density portion is finished.

Then, for exposure of a low density portion, the screen filter 109 is introduced into the light path of the light from the exposure optical system 103, and the optical scan is carried out in the described manner. Namely, in the exposure with respect to the low density portion, the reflected light off the document 102 is projected onto the photoreceptor 104 after being split into rays by the screen filter 109, thus exposing the photoreceptor 104.

Then, the electrostatic latent image formed by exposure is developed into a toner image of each color component. The toner image formed in this manner is successively transferred onto the color toner image formed on the intermediate transfer medium 120 in the previous transfer process, thus forming another color toner image. In this manner, a complete color toner image is obtained from two color toner images, as obtained from the low density portion and the high density portion, overlapping with each another.

The color toner image formed on the intermediate transfer medium 120 is then transferred by the transfer charger 125 onto the recording sheet 130 which has been supplied from either one of the sheet feeding cassettes 114 and 115. The recording sheet 130 is then separated from the intermediate transfer medium 120 by the separating charger 126 and is guided to the fixing device 129 by the transport belt 128, and the color toner image is heat-fixed in the fixing section 129.

The fixing device 129 is usually provided with a heat roller for heat-fixing the toner image on the recording sheet 130. The surface temperature of the heat roller is controlled to be a set temperature by the ON/OFF operation of a heater lamp. FIG. 28 shows a normal fixing temperature curve when the heater lamp is turned on.

As shown in FIG. 28, when the heater lamp is turned on, the surface temperature of the heat roller gradually increases to the set temperature. When the set temperature is reached, the heater lamp is turned off, but the temperature continues to rise by the remaining heat. When the surface temperature drops below the set temperature, the heater lamp is turned on again. This process is repeated subsequently, and this results in overshoot in which the surface temperature fluctuates.

FIG. 29 shows a change in fixing ability with time. As shown in FIG. 29, the fixing ability is stable on the recording sheet 130 from the front end to the point in length corresponding to the periphery of the heat roller. However, the fixing ability abruptly decreases from the point past the periphery of the heat roller to the rear end of the recording sheet 130. The is because in one rotation of the heat roller, the heat of the heat roller is given off to the recording sheet 130 or the toner to be fixed.

In order to prevent this decrease in fixing ability, as shown in FIG. 30, it has been conventional practice to carry out a control so that the heater lamp is turned on just when the surface temperature of the heat roller starts to fall below the set temperature.

Incidentally, in the described copying machine, transfer of the toner image of each color component from the photoreceptor 104 to the intermediate transfer medium 120 is carried out by the corona discharge of the transfer charger 124. Likewise, transfer of color toner image from the intermediate transfer medium 120 to the recording sheet 130 is also carried out by the corona discharge of the transfer charger 125.

In this kind of corona discharge, the oxygen molecules in the atmosphere are ionized and ozone is generated. Generally, ozone is toxic, and in high concentration, damages the respiratory system, and even a trace amount, when inhaled for an extended period of time, is fatal. Thus, considering environmental friendliness, generation of ozone is not preferable.

From this point of view, the described copying machine, provided with two corona dischargers, which are a source of ozone, lacks consideration for environmental friendliness.

Also, in the described copying machine, the transfer voltage applied by the transfer charger 125 is constant regardless of the type of the recording sheet 130 used. Therefore, there is a case where desirable transfer is obtained in one recording sheet 130 while transfer failure results when another recording sheet 130 having a different thickness is used. Especially, when thin recording sheet 130 is used, there is a case where re-transfer (back-transfer) results, in which the color toner image transferred on the recording sheet 130 is transferred again onto the intermediate transfer medium 120 when removing the recording sheet 130 from the intermediate transfer medium 120. Thus, in the above copying machine, because the transfer voltage is constant, a desirable transfer characteristic in accordance with sheet type is not obtained, and as a result, the printing quality suffers.

Conventionally, a copying machine having a function of changing the transfer voltage in accordance with the sheet feeding cassette storing recording sheets has been available. However, even when the recording sheets stored in the same sheet feeding cassette have the same size, the basis weight (corresponding to thickness) may not be the same. Further, the recording sheets having the same size may be transparent or non-transparent. Thus, a transfer characteristic in accordance with sheet type is not realized even with this arrangement.

Also, in the conventional fixing mechanism, a control is carried out such that the heater lamp is turned on only when the toner image fixed on the recording sheet 130 exceeds the periphery of the heat roller and when the surface temperature of the heat roller starts to fall below the set temperature. In this case, the surface temperature of the heat roller does not reach the set temperature immediately, and therefore fixing from the point past the periphery of the heat roller to the rear end of the recording sheet 130 is carried out with the surface temperature of the heat roller below the set temperature. As a result, a toner image cannot be fixed uniformly on the recording sheet 130 from the front end to the rear end.

SUMMARY OF THE INVENTION

The present invention offers a solution to the above-mentioned problems, and accordingly it is an object of the present invention to provide an image forming apparatus capable of suppressing generation of ozone and thus the environmental toxicity to minimum, and capable of realizing a desirable transfer characteristic in accordance with a type of a recording sheet, which has been transported, so as to prevent lowering of printing quality.

In order to achieve the above object, an image forming apparatus in accordance with the present invention includes a latent image holding section for holding color-separated image information as an electrostatic latent image; a plurality of developing sections for making the electrostatic latent image held by the latent image holding section visible color by color; an intermediate transfer medium to which a visualized image of each color visualized on a surface of the latent image holding section is successively transferred upon contact with the latent image holding section; a transfer section, which is separable and contactable with respect to the intermediate transfer medium; and a voltage applying section for applying a predetermined voltage to the transfer section, wherein the transfer section carries out both transfers of (A) between the latent image holding section and the intermediate transfer section and (B) between the intermediate transfer medium and the recording medium in accordance with the voltage applied from the voltage applying section.

With this arrangement, the electrostatic latent image formed on the latent image holding section is made visible by the developer of corresponding color. A plurality of visualized images obtained by the plurality of developing sections are overlapped with one another on the intermediate transfer medium, and thereafter are transferred onto the recording medium from the intermediate transfer medium by the application of a voltage from the voltage applying section to the transfer section.

Here, the transfer section independently carries out both transfers of (A) a first transfer for transferring the visualized images formed on the latent image holding section to the intermediate transfer section and (B) a second transfer for transferring the visualized image overlapped on the intermediate transfer medium to the recording medium. Therefore, compared with the conventional case where the first transfer and the second transfer are carried out by separate transfer sections, it is ensured that less ozone is generated.

Namely, when the transfer section happens to be employing, for example, corona discharge, due to the fact that the number of transfer section is reduced, the ozone generated is also reduced. On the other hand, when the transfer section is composed of, for example, a contact roller, no ozone, originating from the transfer section, is generated.

Therefore, with the described arrangement, it is ensured that the ozone, which is toxic to the human body, generated from the whole device is reduced, thus realizing an image forming apparatus which is environmentally friendly.

Further, with the described arrangement, compared with the case where the first transfer and the second transfer are carried out by separate transfer sections, the number of transfer section is reduced, and accordingly it is not required to provide members, such as power source, corresponding to the transfer sections. As a result, the number of components of the device is reduced, thus realizing a compact device.

For a fuller understanding of the nature and advantages of the invention, reference should be made to the ensuing detailed description taken in conjunction with the accompanying drawings.

BRIEF DESCRIPTION OF THE DRAWINGS

FIG. 28 is an explanatory drawing showing a normal change in fixing temperature when the heater lamp is turned on.

DESCRIPTION OF THE EMBODIMENTS

The following will describe one embodiment of an image forming apparatus in accordance with the present invention referring to FIG. 1 through FIG. 26.

Figure 1:
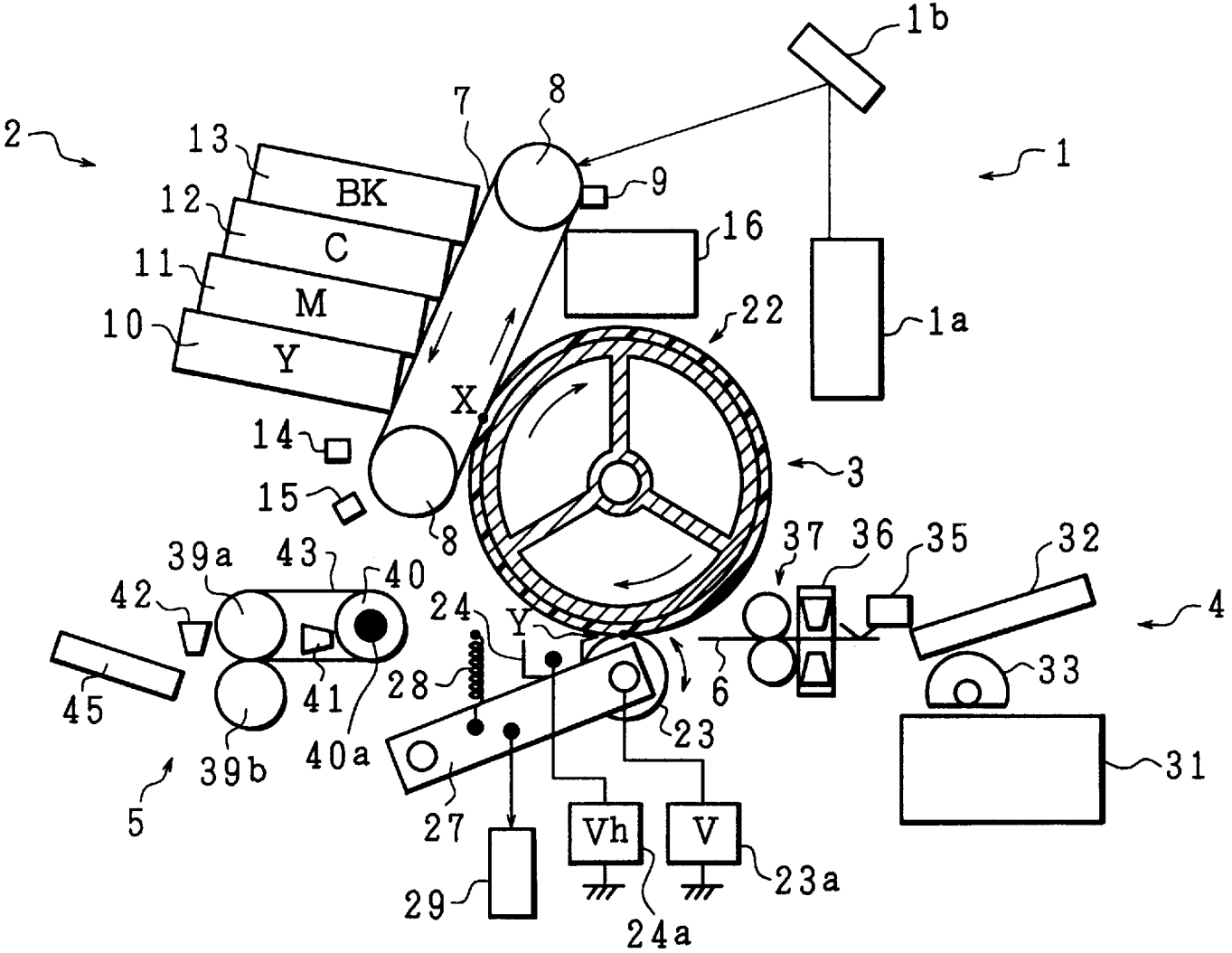
FIG. 1 is an explanatory drawing schematically showing an image forming apparatus in accordance with the present invention.
Figure 2:
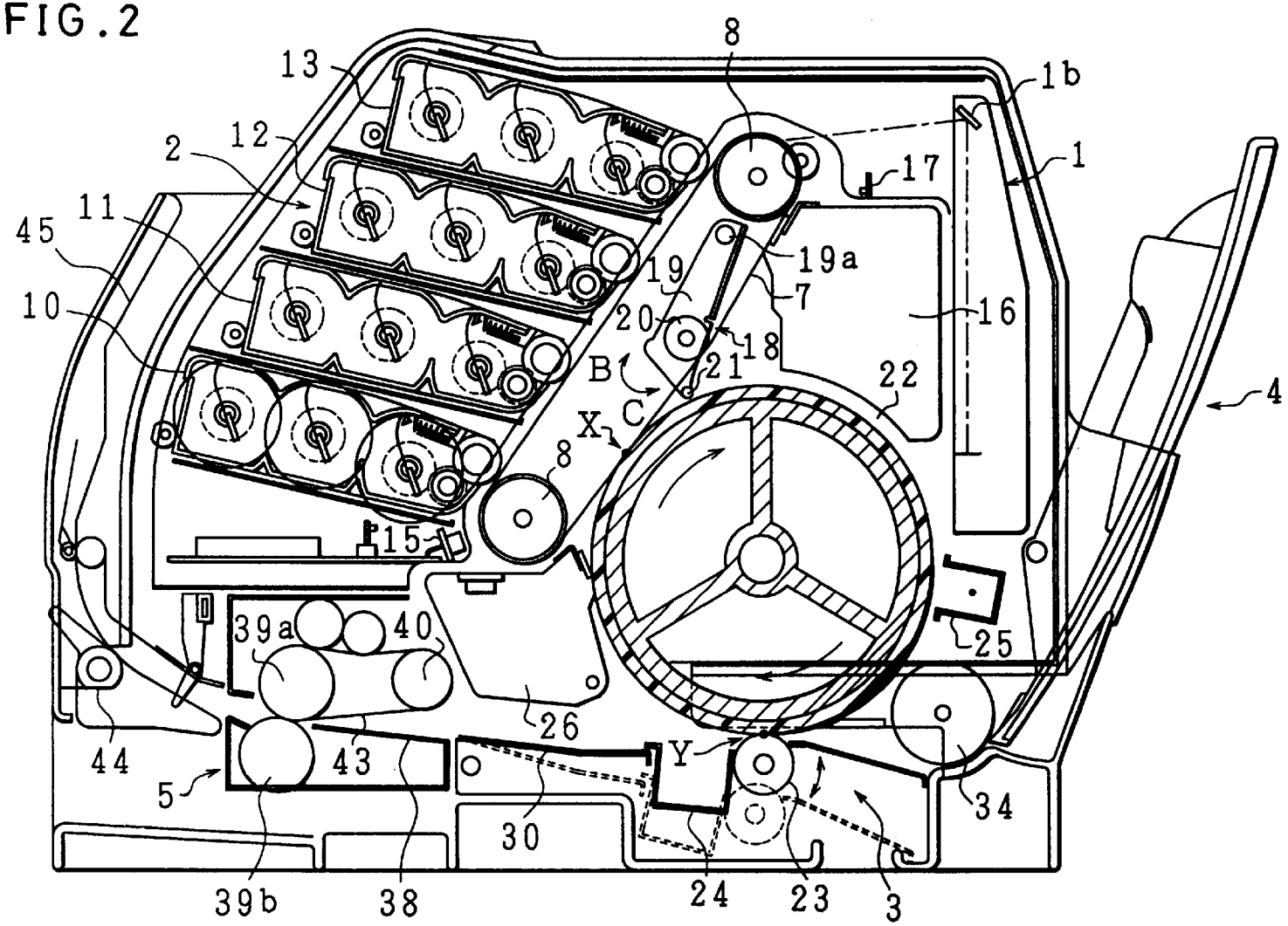
FIG. 2 is a cross sectional view showing a schematic arrangement of the image forming apparatus.

As shown in FIG. 1 and FIG. 2, a color copying machine (referred to simply as "copying machine" hereinafter) as an image forming apparatus in accordance with the present embodiment includes an exposing section 1, a developing section 2, a transfer section 3, a sheet-feeding section 4, and a fixing section 5. FIG. 1 is a schematic drawing showing main components of the copying machine of FIG. 2.

The exposing section 1 projects a laser beam in accordance with a document image onto an outer surface of a photoreceptor 7 (described later) to form an electrostatic latent image thereon. The developing section 2 makes the electrostatic latent image visible using toner (developer). The transfer section 3 carries out a so-called (1) first transfer in which a toner image formed on the photoreceptor 7 is transferred onto an intermediate transfer medium 22 (described later) color by color and (2) second transfer in which a color toner image formed on the intermediate transfer medium 22 is transferred onto a recording sheet 6. The sheet-feeding section 4 stocks recording sheet 6 (recording medium) to which a color toner image is transferred and supplies the recording sheet 6 to the transfer section 3. The fixing section 5 fuses and fixes the toner image transferred on the recording sheet 6. The following describes detailed arrangements of the above sections in the order they were introduced.

The exposing section 1 is composed of a laser scanning unit 1*a* which emits a laser beam in accordance with a document image and a mirror 1*b* which reflects and guides the laser beam to the photoreceptor 7. The laser beam emitted from the laser scanning unit 1*a* is projected on the outer surface of the photoreceptor 7 between a charger 9 and a developer tank 13 (both mentioned later), and this exposes the outer surface of the photoreceptor 7 and an electrostatic latent image is formed on the photoreceptor 7.

The developing section 2 is provided with the photoreceptor 7 (latent image holding device) which is pressed against the intermediate transfer medium 22. The photoreceptor 7 of the present embodiment is a photoreceptive belt made from an OPC (organic Photoconductive Conductor) film, and is suspended by two suspension rollers 8.

Figure 3A:
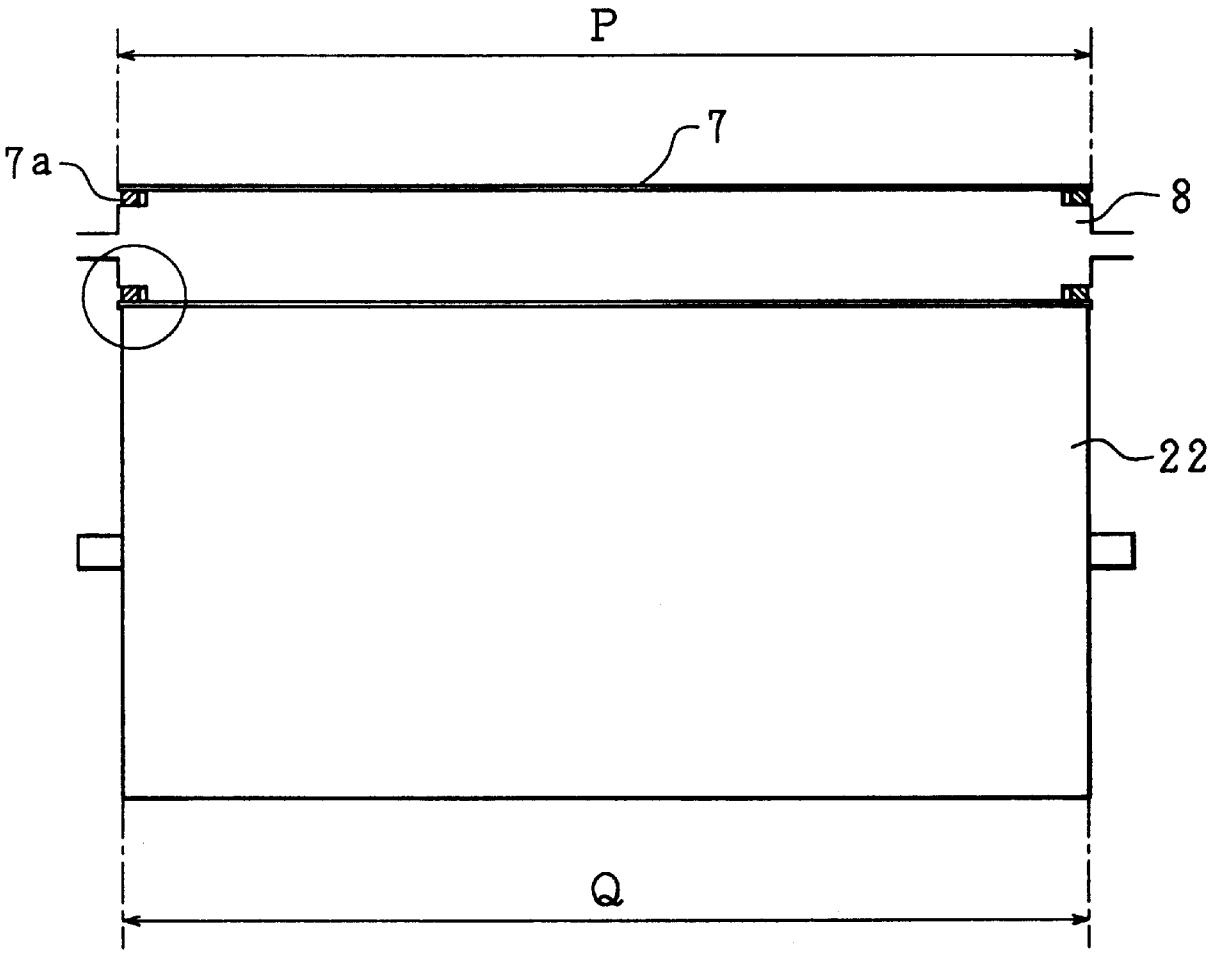
FIG. 3(*a*) and FIG. 3(*b*) are cross sectional views showing a contact between an inner surface of a photoreceptor and a suspension roller of the image forming apparatus in the case where a width of the photoreceptor and a width of the suspension roller are substantially the same.
Figure 3B:
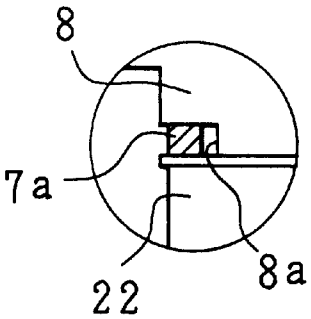
Figure 4A:
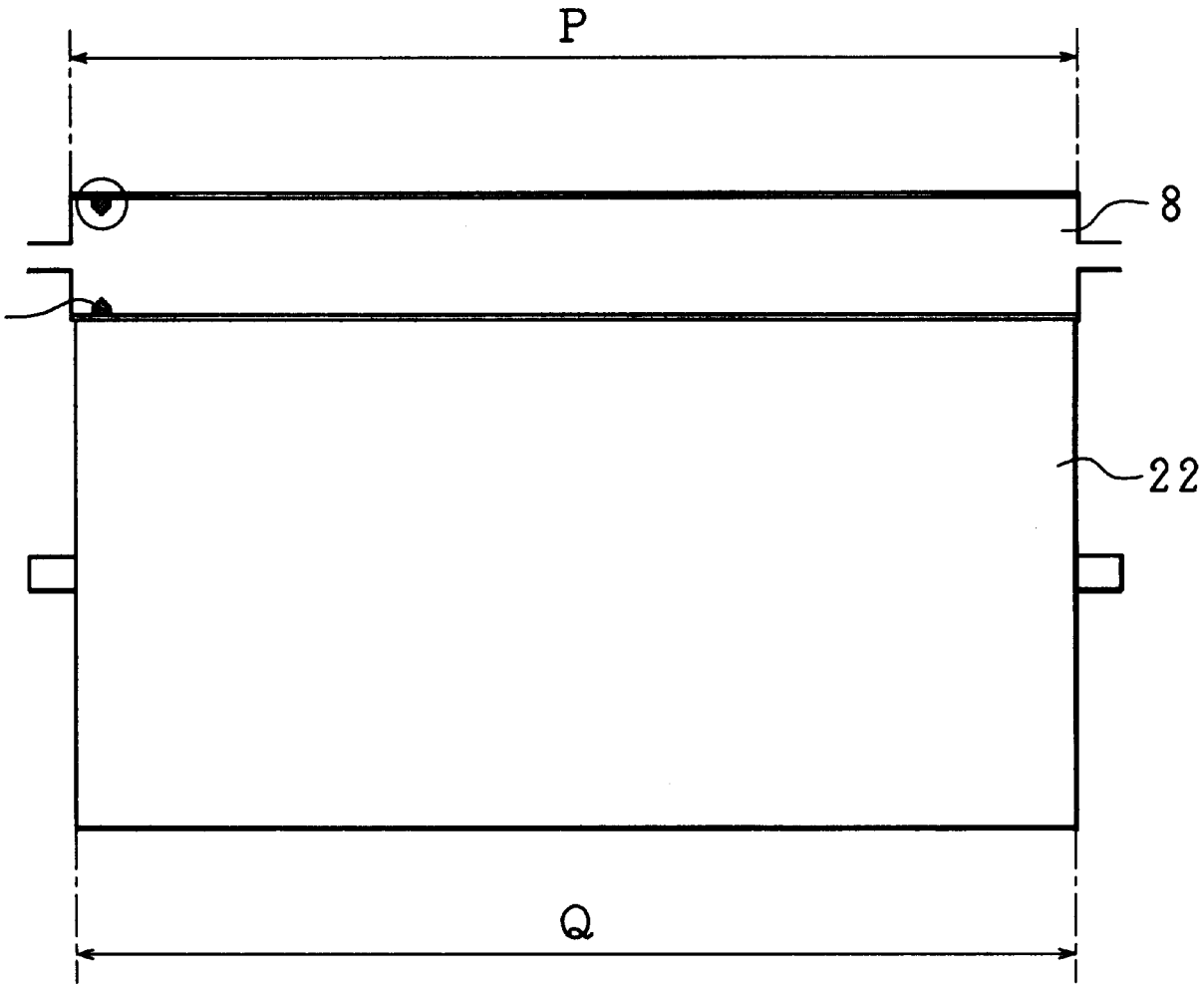
FIG. 4(*a*) and FIG. 4(*b*) are cross sectional views showing a contact between the inner surface of the photoreceptor and the suspension roller of the image forming apparatus in the case where the width of the photoreceptor and the width of the suspension roller are substantially the same.
Figure 4B:
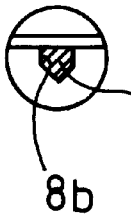

As shown in FIG. 3(*a*) and FIG. 4(*a*), belt width P of the photoreceptor 7 is made substantially the same as drum width Q of the intermediate transfer medium 22. This is for the following reason.

In general, the inner surface of the photoreceptor 7 is provided with bead sections 7*a*. The bead sections 7*a* are brought into contact with step-difference sections 8*a* provided on the both ends in the axis direction of each of the suspension rollers 8, or alternatively, as shown in FIG. 4(*b*), engaged with grooves 8*b*. The bead sections 7*a* are regulated by the step-difference sections 8*a* or by the grooves 8*b* and wobbling of the photoreceptor 7 is minimized.

Figure 5A:
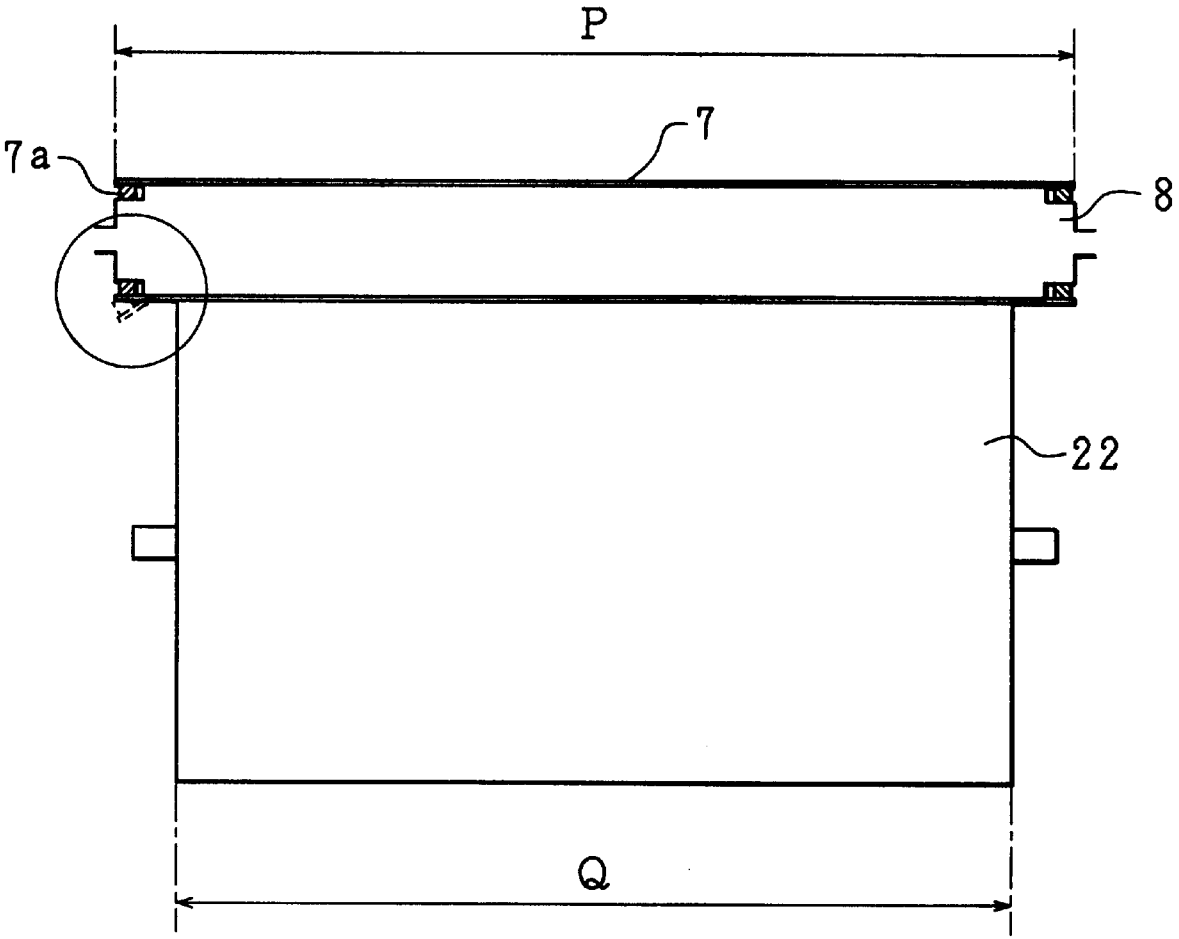
FIG. 5(*a*) and FIG. 5(*b*) are cross sectional views showing a contact between the inner surface of the photoreceptor and the suspension roller of the image forming apparatus in the case where the width of the photoreceptor is larger than the width of the suspension roller.
Figure 5B:
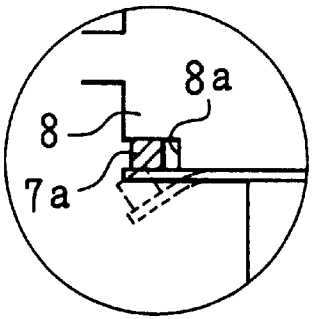

When the belt width P of the photoreceptor 7 is larger than the drum width Q of the intermediate transfer medium 22, as shown in FIG. 5(*a*), the bead sections 7*a* are more likely to be separated from, for example, the step-difference sections 8*a* by the pressing of the intermediate transfer medium 22, as shown in FIG. 5(*b*), and this causes the photoreceptor 7 to wobble.

By providing the photoreceptor 7 in such a manner that the belt width P is substantially equal to the drum width Q, the bead sections 7 a are prevented from separating from the step-difference sections 8*a* or from the grooves 8*b*, and wobbling of the photoreceptor 7 in the axis direction is minimized.

Note that, in the arrangement of FIG. 3(*a*) and FIG. 3(*b*), considering the margin required for placing the suspension rollers 8 on the inner surface of the photoreceptor 7, a clearance is provided between the step-difference sections 8*a* and the bead sections 7*a* in the axis direction of the suspension rollers 8. Thus, even though the belt width P and the drum width Q are substantially equal, slight wobbling of the photoreceptor 7 still occurs. On the other hand, in the arrangement of FIG. 4(*a*) and FIG. 4(*b*), since the bead sections 7*a* are engaged with the grooves 8*b*, the wobbling of the photoreceptor 7 in the axis direction is substantially completely prevented. Therefore, in practice, the arrangement of FIG. 4(*a*) and FIG. 4(*b*) is more preferable than that of FIG. 3(*a*) and FIG. 3(*b*). Nevertheless, the photoreceptor 7 wobbles less often in the arrangement of FIG. 3(*a*) and FIG. 3(*b*) compared with the arrangement of FIG. 5(*a*) and FIG. 5(*b*).

As shown in FIG. 1 and FIG. 2, around the photoreceptor 7 are provided the charger 9, developer tanks 10 to 13 (developing means), a density sensor (TMA: Toner Mass Area Sensor) 14, a surface stabilizer 15, a cleaning device 16, and a discharge lamp 17.

The charger 9 charges the outer surface of the photoreceptor 7, and in the present embodiment, is composed of a static charger with a grid. Alternatively, the charger 9 may be composed of a static brush or static roller, etc.

The developer tanks 10 to 13 store toners of yellow (Y), magenta (M), cyan (C), and black (BK), respectively, and develop the electrostatic latent image formed on the photoreceptor 7 with respect to each color so as to form a toner image of each color on the photoreceptor 7. Note that, in the present embodiment, the toners of the above colors are negatively charged; however, the principle of the present embodiment can also be applicable to positively charged toner. Also, the developer tanks 10 to 13 of the present embodiment are composed of a developer-hopper section which is an integral unit of a developer section and a hopper section.

The density sensor 14 detects the density of a toner layer on the outer surface of the photoreceptor 7, and in the case where the density is lower than the usual, tells an operator through, for example, a display section (not shown) to replenish the toner of a color displayed on the display section to the developer tank. The surface stabilizer 15 is composed of at least one of a PTC (Pre-Transfer Charger) and PTL (Pre-Transfer Lamp) and stabilizes the charge on the outer surface of the photoreceptor 7 to increase the transfer efficiency in the first transfer (described later).

The cleaning device 16 removes waste toner which was not transferred to the intermediate transfer medium 22 and is remaining on the photoreceptor 7, and also removes waste toner adhering on a transfer roller 23 (mentioned later). The cleaning device 16 of the present embodiment is of a blade type, but may also be composed of an electrostatic brush alternatively.

The discharge lamp 17 discharges the outer surface of the photoreceptor 7. It is preferable that the electric potential on the outer surface of the photoreceptor 7 is set to 0 V by the effect of the discharge lamp 17. However, removal of charge needs not to be so complete.

In the described photoreceptor 7, the process of charging, exposure, development, and transfer is repeated for each color. Thus, a toner image of one color is transferred onto the intermediate transfer medium 22 from the photoreceptor 7 per one rotation of the intermediate transfer medium 22, and a color toner image is obtained by at the maximum of four rotations of the intermediate transfer medium 22.

Figure 6:
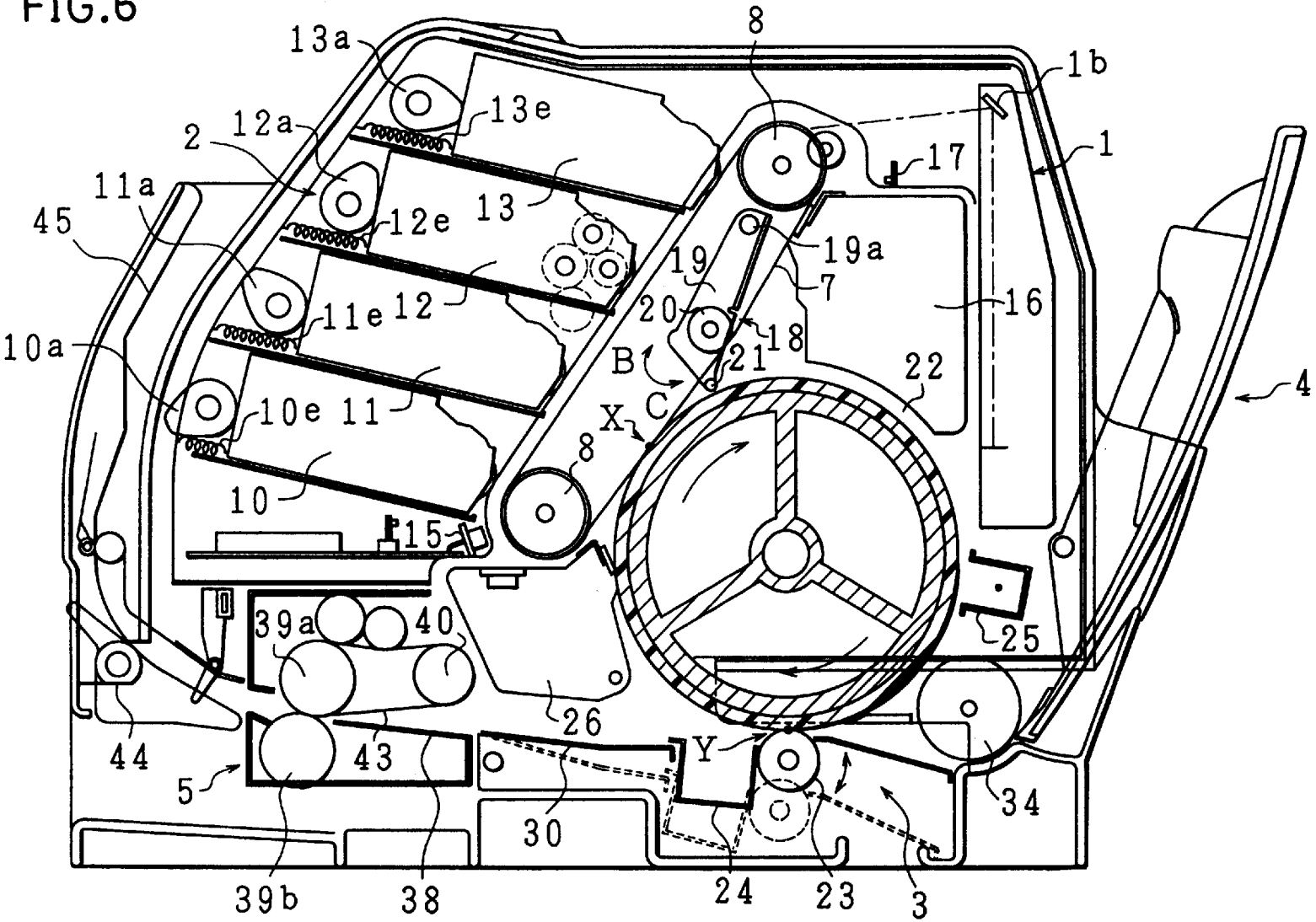
FIG. 6 is a cross sectional view showing a detailed arrangement of a developing section of the image forming apparatus.
Figure 7:
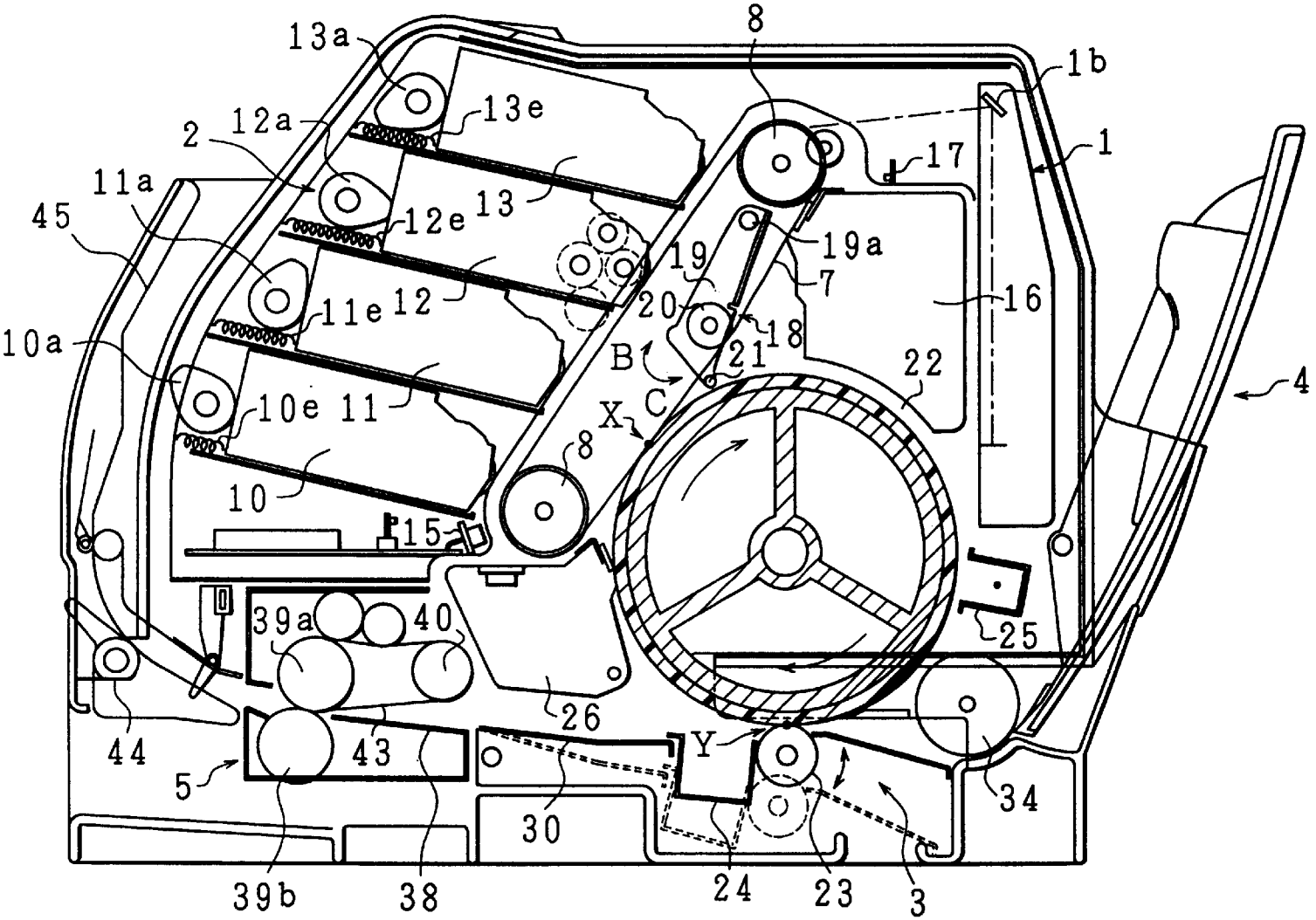
FIG. 7 is a cross sectional view showing a detailed arrangement of a developing section of the image forming apparatus.

As shown in FIG. 6 and FIG. 7, on the side of the developer tanks 10 to 13 opposite to the photoreceptor 7, there are provided developer tank pressing cams 10*a* to 13*a*, respectively, for pressing the developer tanks 10 to 13 against the photoreceptor 7, the developer tank pressing cams 10*a* to 13*a* being always in contact with the developer tanks 10 to 13, respectively. The driving shafts of the developer tank pressing cams 10*a* to 13*a* are all connected to a single driving source. The developer tanks 10 to 13 are also pressed against the corresponding developer tank pressing cams 10*a* to 13*a* by retaining means such as springs 10*e* to 13*e*.

The following describes a separating-contacting operation of the developer tanks 10 to 13 with respect to the photoreceptor 7 by the rotation of the developer tank pressing cams 10*a* to 13*a*. Note that, the following explanations are based on, for example, the structure of the developer tank 12 filled with cyan toner and the separating-contacting operation of the developer tank 12 with respect to the photoreceptor 7. The other developer tanks 10, 11, and 13 are the same as the developer tank 12, and therefore explanations thereof are omitted here.

Figure 8:
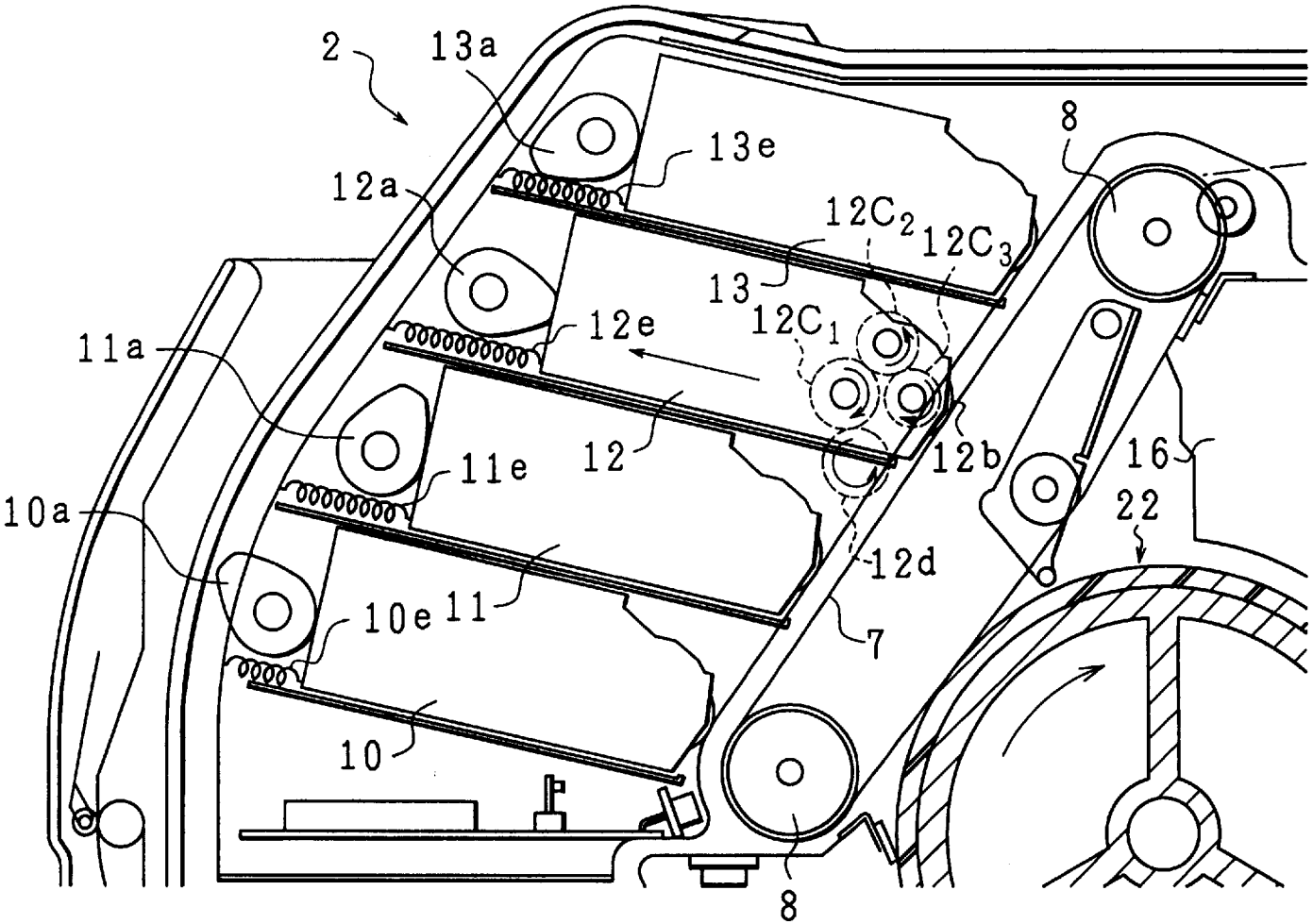
FIG. 8 is an enlarged cross sectional view of the developing section.

As shown in FIG. 8, the developer tank 12 is provided with a development roller 12*b* and driving gears $\mathbf{12}c_1$ to $\mathbf{12}c_3$ which are in mesh with one another. The development roller 12*b* is integrally and coaxially provided with the driving gear $\mathbf{12}c_3$. The driving gear $\mathbf{12}c_1$ is provided in such a manner that it can be brought into mesh with a driving gear 12*d* which is provided on the copying machine main body. In FIG. 8, the driving gear 12*d* is rotating counterclockwise. The developer tank pressing cam 12*a* is provided such that the developer tank 12 is pressed against the photoreceptor 7 by the rotation of the developer tank pressing cam 12*a* when developing, and that the development roller 12*b* is separated from the photoreceptor 7 by a predetermined distance when not developing.

In this arrangement, when the developer tank 12 is pressed against the photoreceptor 7 by the counterclockwise rotation of the developer tank pressing cam 12*a*, the driving gear $\mathbf{12}c_1$ is brought into mesh with the driving gear 12*d*, and the development roller 12*b* comes into contact with the outer surface of the photoreceptor 7. This transmits the rotational force of the driving gear 12*d* to the development roller 12*b* via the driving gears $\mathbf{12}c_1$ to $\mathbf{12}c_3$, and the development roller 12*b* rotates clockwise in FIG. 8. As a result, the cyan toner is released from the developer tank 12, and a toner image of cyan is formed on the photoreceptor 7.

Then, as the developer tank pressing cam 12*a* rotates further, by the retaining force of the spring 12*e*, the developer tank 12 separates from the photoreceptor 7 while being in contact with the developer tank pressing cam 12*a*. This releases the contact between the development roller 12*b* and the photoreceptor 7, and the development of cyan is finished. Here, the development roller 12*b* is held with a constant distance from the photoreceptor 7 all the time until the next round of development is started.

Therefore, even when the developer tank 12 is shuddered by the rotation of the development roller 12*b* and the driving gears $\mathbf{12}c_1$ to $\mathbf{12}c_3$, because the development roller 12*b* and the photoreceptor 7 are separated from each other with a predetermined distance when development is not being carried out, deterioration of image quality due to shudder does not occur and a high quality image is obtained.

Note that, it is not necessarily the case that the order of development by the developer tanks 10 to 13 starts from the developer tank 12. It may start from, for example, development of black by the developer tank 13. FIG. 6 through FIG. 8 illustrate such a case in the pressing mechanism of the developer tanks 10 to 13.

As shown in FIG. 2, the developing section 2 is provided with a belt separating-contacting mechanism 18. The belt separating-contacting mechanism 18 is composed of (i) a tension plate 19 which is rotatably movable in the B–C directions in FIG. 2 round the support of a rotation shaft 19*a* in the vicinity of one of the suspension rollers 8, (ii) a tension roller 20 attached to the tension plate 19, contacting the inner surface of the photoreceptor 7, and (iii) a release shaft 21 which can be brought into contact with the outer surface of the photoreceptor 7.

Figure 9:
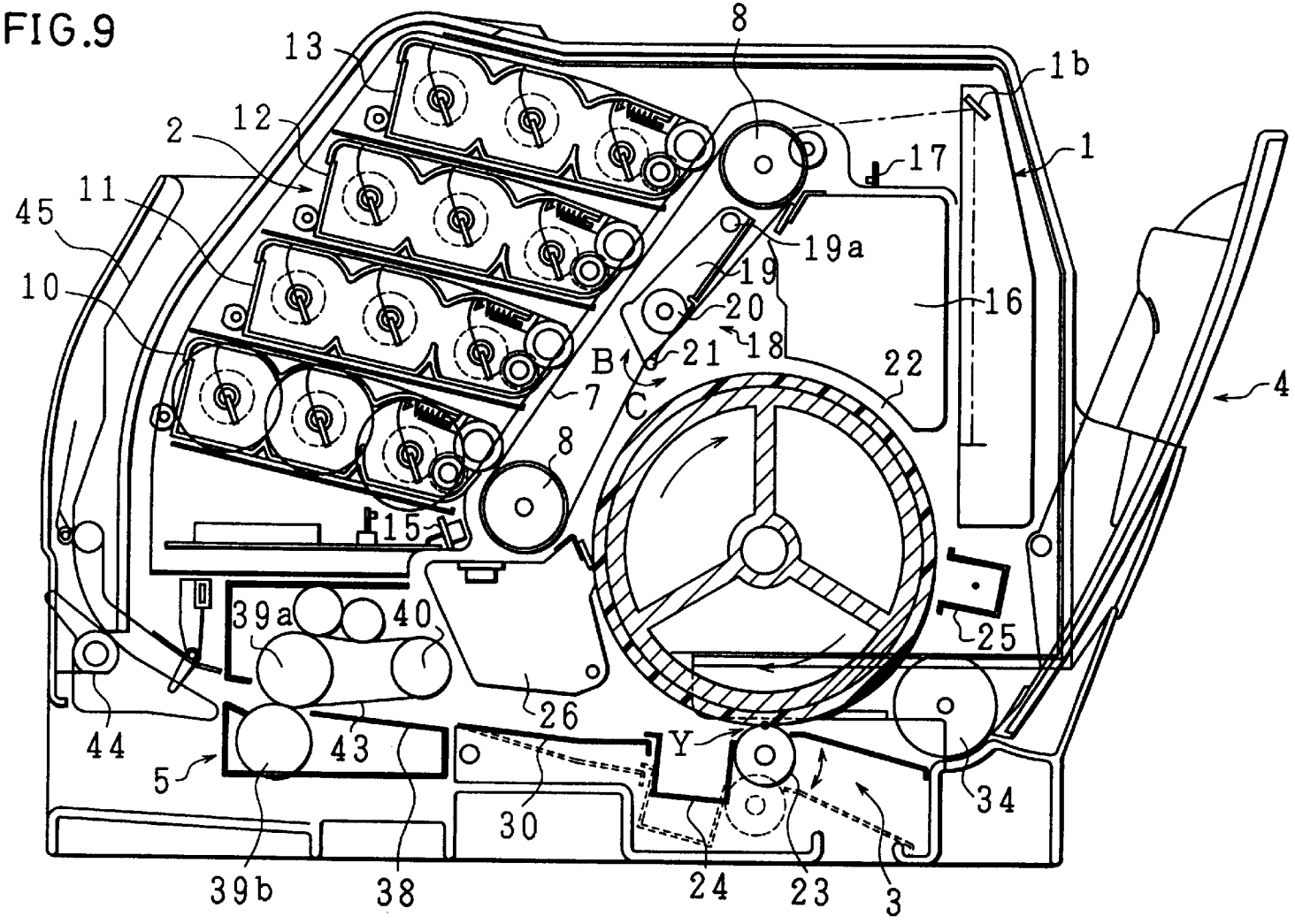
FIG. 9 is a cross sectional view showing a detailed structure of a separating-contacting mechanism of the photoreceptor of the image forming apparatus.

Therefore, as shown in FIG. 9, when the tension plate 19 is rotatably moved in the B direction in FIG. 9, the contact between the photoreceptor 7 and the intermediate transfer medium 22 is released as the release shaft 21 is brought into contact with the outer surface of the photoreceptor 7. This allows the photoreceptor 7, whose life has ended for example, to be taken out of the copying machine main body and replaced with a new one. To install the photoreceptor 7 in the copying machine main body, the photoreceptor 7 is inserted into a predetermined position with the tension plate 19 rotatably moved in the B direction, and then the tension plate 19 is rotatably moved in the C direction so as to allow the outer surface of the photoreceptor 7 to contact with the intermediate transfer medium 22, thus installing the photoreceptor 7 in the copying machine without damaging the outer surface of the photoreceptor 7.

Figure 10:
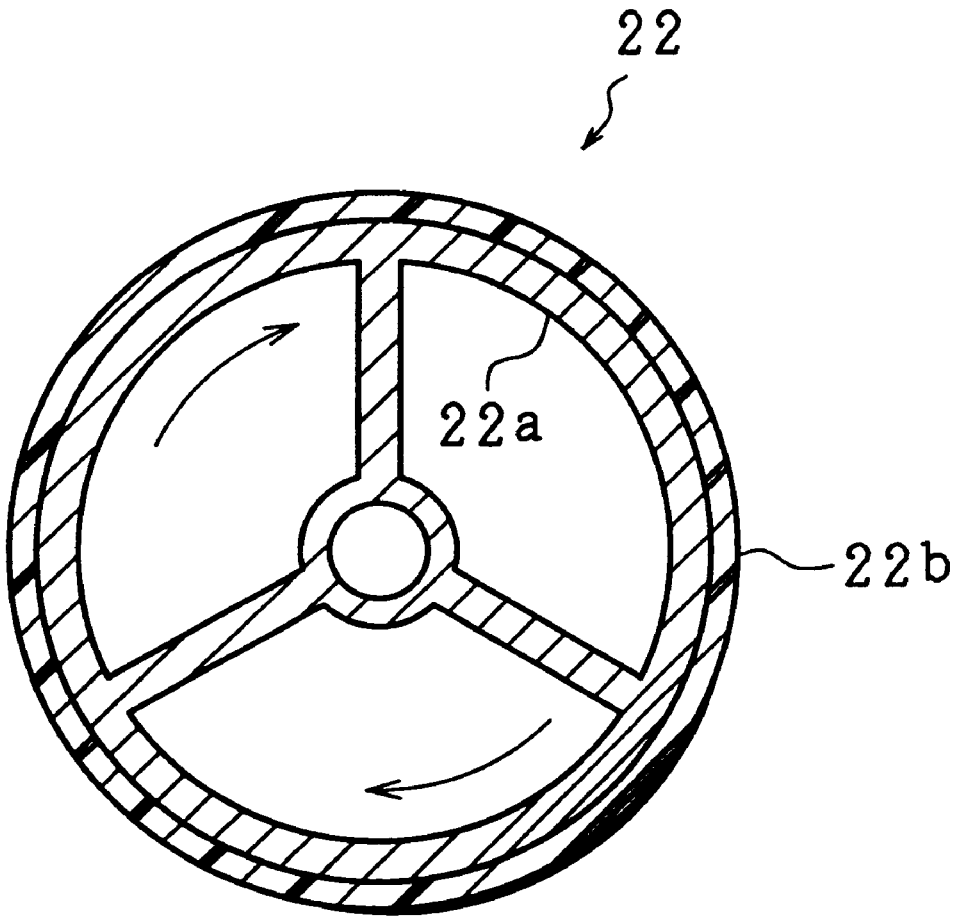
FIG. 10 is a cross sectional view showing a detailed structure of an intermediate transfer medium provided in the image forming apparatus.

As shown in FIG. 1 and FIG. 2, the transfer section 3 includes the intermediate transfer medium 22 having a drum shape, and the toner image formed on the outer surface of the photoreceptor 7 is transferred onto the intermediate transfer medium 22. The intermediate transfer medium 22 is composed of, as shown in FIG. 10, a metal drum 22*a* having a cylindrical shape and a semiconductive resin film 22*b*. The semiconductive resin film 22*b* is integrally formed around the outer surface of the metal drum 22*a* by heat-shrinkage, and is made of a material such as polyimide, nylon, and fluorine.

When the metal drum 22*a* and the semiconductive resin film 22*b* are integrally formed in this manner, the intermediate transfer medium 22 can be used for the same duration as the machine life of the copying machine main body. Also, since the intermediate transfer medium 22 is a drum unit, compared with the case where the intermediate transfer medium is composed of a belt and a plurality of suspension rollers, the number of components can be reduced, thus reducing the overall costs.

Also, when a belt intermediate transfer medium is adopted, the overlapping accuracy of toner images from the photoreceptor to the intermediate transfer medium is lowered by the wobbling of the belt. However, in the present embodiment, since the intermediate transfer medium 22 having a drum shape is adopted, wobbling does not occur, and the lowering of the overlapping accuracy of toner images as caused by wobbling is prevented.

The volume resistivity of the semiconductive resin film 22*b* is set in a range of $10^6$ to $10^{12}$ Ω·cm. When the volume resistivity is smaller than $10^6$ Ω·cm, the voltage applied to the intermediate transfer medium 22 is given off via the metal drum 22*a*, and does not remain on the intermediate transfer medium 22. When the volume resistivity is larger than $10^{12}$ Ω·cm, the voltage applied to the intermediate transfer medium 22 is held in excess and sufficient discharge cannot be carried out even when discharge is required. As a result, the potential of the semiconductive resin film 22*b* is increased further, raising the possibility of leaking between the intermediate transfer medium 22 and the photoreceptor 7 upon contact. Therefore, in the present embodiment, the volume resistivity of the semiconductive resin film 22*b* is set in the above range, ensuring that a predetermined voltage is maintained and sufficient discharge is carried out when discharge is required. As a result, first through fourth transfers (described later) are carried out with certainty.

In addition to the intermediate transfer medium 22, the transfer section 3 further includes the transfer roller 23 (transfer device), a sheet removal charger 24, a pre-transfer discharger 25, and a cleaning device 26.

The transfer roller 23 presses the recording sheet 6, which has been transported to the transfer section 3, against the intermediate transfer medium 22. The transfer roller 23 is supported by a supporting member 27, and is retained all the time in a direction towards the intermediate transfer medium 22 by a transfer roller pressing spring 28 attached to the supporting member 27. The pressing and separating operation of the transfer roller 23 with respect to the intermediate transfer medium 22 is controlled by an ON/OFF operation of a transfer roller separating solenoid 29 attached to the supporting member 27.

The transfer roller 23 is connected to a power source 23*a* (voltage applying device) and a predetermined voltage is applied to the transfer roller 23 from the power source 23*a*. Note that, details of voltage application of the power source 23*a* to the transfer roller 23 will be described later.

The sheet removal charger 24 is supported by the supporting member 27 as with the transfer roller 23, and is operated in synchronization with the separating-contacting operation of the transfer roller 23 with respect to the intermediate transfer medium 22. The sheet removal sheet 24 is connected to a power source 24*a*. Thus, after transferring of a color toner image from the intermediate transfer medium 22 to the recording sheet 6 is finished, by application of a predetermined voltage from the power source 24*a*, the recording sheet 6 is removed electrostatically from the intermediate transfer medium 22. The recording sheet 6 removed is transported to the fixing section 5 by being guided by a transport guide 30.

Note that, the operation of the sheet removal charger 24 is not necessarily required to be in synchronization with the separating-contacting operation of the transfer roller 23. Alternatively, the sheet removal charger 24 may be fixably provided in the vicinity of the intermediate transfer medium 22 without the support of the supporting member 27.

The pre-transfer discharger 25 removes charge on the surface of the intermediate transfer medium 22 before the toner image of each color is transferred to the intermediate transfer medium 22 from the photoreceptor 7, and is composed of, for example, PTC. This reduces the amount of charge on toner on the surface of the intermediate transfer medium 22 and increases the transfer efficiency in the second transfer (described later) . The cleaning device 26 removes toner adhered on the surface of the intermediate transfer medium 22.

Note that, in the present embodiment, the cleaning device 26 is not necessarily required and can be excluded. When the cleaning device 26 is provided, it is ensured that the surface of the intermediate transfer medium 22 is cleaned by the cleaning device 26 per predetermined rotations of the intermediate transfer medium 22.

On the both ends in the axis direction of the intermediate transfer medium 22 are provided flanges made of insulator. The intermediate transfer medium 22 is mounted on the frame of the main body via bearings attached to the flanges. Thus, the intermediate transfer medium 22 is rotatably fixed while being insulated from the main body frame, and adverse electric effects from surrounding devices are eliminated, thus maintaining the surface of the intermediate transfer medium 22 electrically stable.

The following will describe in detail voltage application of the power source 23*a* to the transfer roller 23. The power source 23*a* applies, as shown in Table 1, different voltages to the transfer roller 23 in a pre-processing stage (first stage), a transfer stage (second stage), and a post-processing stage (third stage).

TABLE 1

| | Pre-Processing Stage | . . . | Transfer Stage | Post-Processing Stage | . . . |
|---|---|---|---|---|---|
| State of Transfer Roller With Respect to Intermediate Transfer Medium | contacting | separating | contacting | contacting | separating |
| Voltage Applied to Transfer Roller | +50 V to +500 V | 0 V | +100 V to +2000 V | −500 V to +5000 V<br>−50 V to −500 V | 0 V |

Here, the pre-processing stage refers to a period between turning on of the copying machine and the start of development of a first color (for example, yellow). In this stage, the transfer roller separating solenoid 29 is turned off, and the transfer roller 23 is brought into contact with the intermediate transfer medium 22, and the power source 23*a* applies a first voltage, for example in a range of +50 V to +500 V, having the opposite polarity to that of the toner, to the transfer roller 23. The first voltage in this range is sufficient for first transfer. As a result, a charge required for first transfer is sufficiently maintained on the surface of the intermediate transfer medium 22, setting a condition for the first transfer of the toner image of each color from the photoreceptor 7 to the intermediate transfer medium 22.

When the application of the predetermined voltage by the power source 23*a* is finished, the transfer roller separating solenoid 29 is turned on, and the transfer roller 23 is separated from the intermediate transfer medium 22. The transfer roller 23 is kept separated from the intermediate transfer medium 22 while maintaining the applied voltage to the transfer roller 23 at 0 V until transfer of the toner images of all four colors from the photoreceptor 7 to the intermediate transfer medium 22 is finished. This prevents the toner image transferred to the intermediate transfer medium 22 from being disturbed by the transfer roller 23.

The transfer stage refers to the stage of second transfer, in which the color toner image of four colors formed on the intermediate transfer medium 22 is transferred to the recording sheet 6 at once. Thus, in this stage, the transfer roller separating solenoid 29 is turned off again at a timing when the front end of the color toner image formed on the intermediate transfer medium 22 coincides with the front end of the recording sheet 6, and the transfer roller 23 is brought into contact with the intermediate transfer medium 22. Here, a second voltage, for example, a voltage in a range of +100 V to +2000 V, higher than the voltage applied in the pre-processing stage is applied to the transfer roller 23 by the power source 23*a*. The second voltage in this range is sufficient for second transfer.

As a result, the color toner image is transferred to a predetermined position on the recording sheet 6, and the second transfer from the intermediate transfer medium 22 to the recording sheet 6 is smoothly carried out. Note that, in the transfer stage, the transfer roller separating solenoid 29 is not turned on even when the second transfer is finished, and the transfer roller 23 is kept contacted with the intermediate transfer medium 22.

The post-processing stage refers to a stage in which a third transfer and a fourth transfer are carried out: the third transfer for transferring toner adhering on the transfer roller 23 back to the intermediate transfer medium 22 after second transfer; and the fourth transfer for transferring toner adhering on the intermediate transfer medium 22 back to the photoreceptor 7 after the third transfer. Namely, the post-processing stage cleans the surfaces of the intermediate transfer medium 22 and the transfer roller 23, and therefore is a preparing stage for the next copying operation.

In the third transfer, continuing from the second transfer, the transfer roller separating solenoid 29 remains off, and the transfer roller 23 remains contacting the intermediate transfer medium 22. And, a third voltage, for example, a voltage in a range of −500 V to +1500 V, lower than the second voltage is applied to the transfer roller 23 by the power source 23*a*. The third voltage in this range is sufficient for third transfer.

Here, when a voltage of, for example, +2000 V is applied to the transfer roller 23 in the second transfer, a voltage of, for example, +1500 V is applied to the transfer roller 23 in the third transfer. That is, a voltage applied in the third transfer is more negative than a voltage applied in the second transfer. This is indeed the same as applying a negative voltage. As a result, it is ensured that the toner adhering on the transfer roller 23 is returned to the intermediate transfer medium 22, thus ensuring that the rear surface of the recording sheet 6 is not contaminated by the contaminants on the transfer roller 23.

Meanwhile, in the fourth transfer, a fourth voltage still lower than the third voltage, for example, a voltage in a range of −50 V to −500 V is applied to the transfer roller 23 by the power source 23*a* while the transfer roller 23 remains contacting the intermediate transfer medium 22. The fourth voltage in this range is sufficient for fourth transfer. As a result, it is ensured that the toner adhering on the intermediate transfer medium 22 is returned to the photoreceptor 7, and the surface of the intermediate transfer medium 22 is cleaned. Also, because the third voltage and the fourth voltage are different, the toner on the intermediate transfer medium 22 does not adhere on the transfer roller 23, thus cleaning both the transfer roller 23 and the intermediate transfer medium 22. When the fourth transfer is finished, the transfer roller separating solenoid 29 is turned on, and the transfer roller 23 is separated from the intermediate transfer medium 22, finishing the preparation for the next image forming process.

Note that, in the described transfer stages, a wide range of voltages are applied to the transfer roller 23. This is for consideration of the thickness of the recording sheet 6, diminishing of the charge with time, and other variables involved. Namely, as the recording sheet 6 becomes thicker or the charge diminishes abruptly, a higher voltage is required. The voltage applied in each of the above transfer stages is controlled by a CPU 47 (mentioned later).

The sheet feeding section 4 is provided with a sheet feeding cassette 31 for stocking the recording sheet 6 of a predetermined size and a manual sheet feeding section 32. The sheet feeding section 31 is provided below the manual sheet feeding section 32 and is detachable with respect to the copying machine. The recording sheet 6 stocked in the sheet feeding section 31 is transported one by one from the top of the sheet feeding cassette 31 by a pickup roller 33 towards the transfer section 3. In contrast, the recording sheet 6 manually supplied one by one to the manual sheet feeding section 32 is transported to the transfer section 3 by a manual roller 34.

The sheet feeding section is also provided with a sheet presence detecting sensor 35, a sheet type detecting section 36 (sheet type detecting means), and aligning rollers 37.

These are provided in this order along the transport direction of the recording sheet 6 from the manual roller 34 to the transfer section 3.

The sheet presence detecting sensor 35 detects the presence or absence of the recording sheet 6 transported from the sheet feeding section 4 to the transfer section 3. The sheet type detecting section 36 detects the sheet type, such as transparency, thickness, color, and length, of the recording sheet 6, which are used as criteria for deciding whether the recording sheet 6 is a transparent film used in an OHP (Overhead Projector) or a non-transparent film. Note that, in the following, the transparent film will be referred to as an OHP film.

The sheet type detecting section 36 is provided between the manual sheet feeding section 32 and the transfer section 3. This ensures early detection of the sheet type of the recording sheet 6, allowing easy control of the transfer voltage applied to the transfer roller 23 and of the fixing temperature in the fixing section 5 in the following process. The sheet type detecting section 36 will be described later in more detail.

In the case of automatic feeding, the CPU 47 (mentioned later) detects the type of the sheet feeding cassette 31 storing the recording sheet 6 of a predetermined size so as to detect the length of the recording sheet 6 based on the type of the sheet feeding cassette 31 thus detected. In this case, the length of the recording sheet 6 is detected before the detection by the sheet type detecting section 36, thus allowing the controls in the following processes to be carried out with more ease.

The aligning rollers 37 temporarily stop the recording sheet 6 being transported so as to transport the recording sheet 6 to the transfer section 3 at a predetermined timing. The predetermined timing is the instance where the front end of the color toner image on the intermediate transfer medium 22 coincides with the front end of the recording sheet 6 at a transfer position of the color toner image from the intermediate transfer medium 22 to the recording sheet 6.

The fixing section 5 includes a transport guide 38, fixing rollers 39*a* and 39*b*, a heat roller 40, a fixing temperature sensor 41, and a sheet sensor 42.

The transport guide 38 guides the recording sheet 6 transported from the transfer section 3 to a region between the fixing rollers 39*a* and 39*b*. The fixing rollers 39*a* and 39*b* fuse the toner image with a predetermined temperature and pressure so as to fix the toner image on the recording sheet 6. The heat roller 40 is provided with a heater lamp 40*a* (heating device), and the temperature of the surface of the heat roller 40 is set by the ON/OFF operation of the heater lamp 40*a*. The fixing roller 39*a* and the heat roller 40 are suspended by a fixing belt 43 (fixing device). The fixing temperature sensor 41 detects the temperature on the surface of the heat roller 40. The sheet sensor 42 detects the presence or absence of the recording sheet 6 discharged from the fixing rollers 39*a* and 39*b*. Note that, details of a fixing temperature control will be described later.

On the downstream side of the sheet sensor 42 in the transport direction of the recording sheet 6 are provided a discharge roller 44 and a discharge tray 45. The discharge roller 44 discharges the recording sheet 6 which has been fixed to the discharge tray 45, and the discharge tray 45 receives the recording sheet 6 thus discharged.

Figure 11:
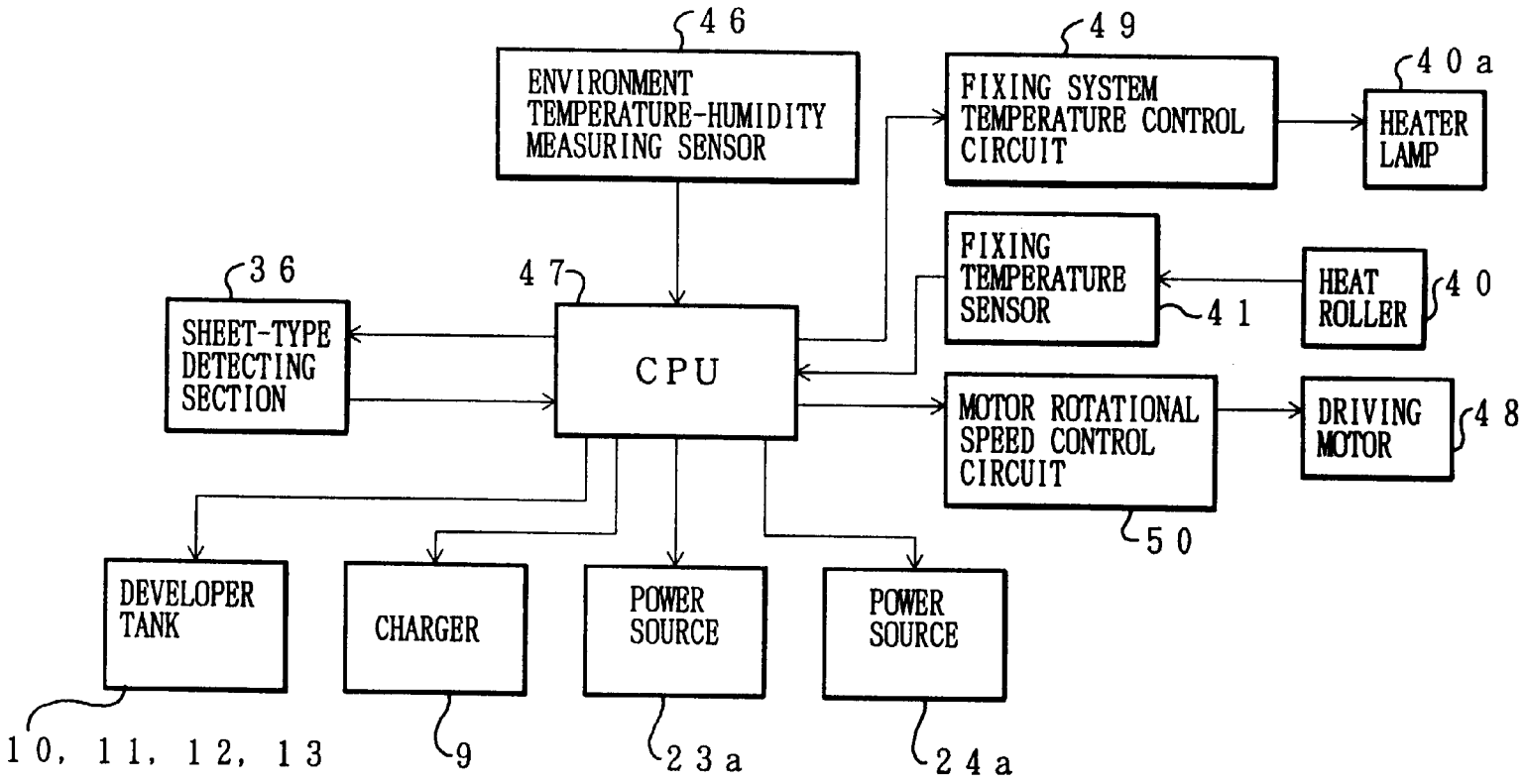
FIG. 11 is a block diagram showing a control by a CPU provided in the image forming apparatus.

As shown in FIG. 11, the copying machine main body is provided with an environment temperature-humidity measuring sensor 46 and the CPU (Central Processing Unit) 47. The environment temperature-humidity measuring sensor 46 measures the temperature and humidity of the environment in which the copying machine is set.

The CPU 47 (control means, fixing temperature control means) controls various parameters in accordance with output signals from the sheet type detecting section 36, the fixing temperature sensor 41, and the environment temperature-humidity measuring sensor 46. The various parameters include, for example, the voltage of the power source 23*a* applied to the transfer roller 23, the voltage of the power source 24*a* applied to the sheet removal charger 24, an image bias voltage, a voltage for charging the photoreceptor 7, the temperature of the heater lamp 40*a*, the rotational speed of the driving motor 48 for driving the fixing rollers, and the amount of light emitted by a light emitting element 51 (mentioned later) of the sheet type detecting section 36, etc.

The temperature control of the heater lamp 40*a* is carried out by a fixing system temperature control circuit 49 in accordance with a control signal from the CPU 47. The rotational speed of the driving motor 48 is controlled by a motor rotational speed control circuit 50 in accordance with a control signal from the CPU 47.

Figure 12:
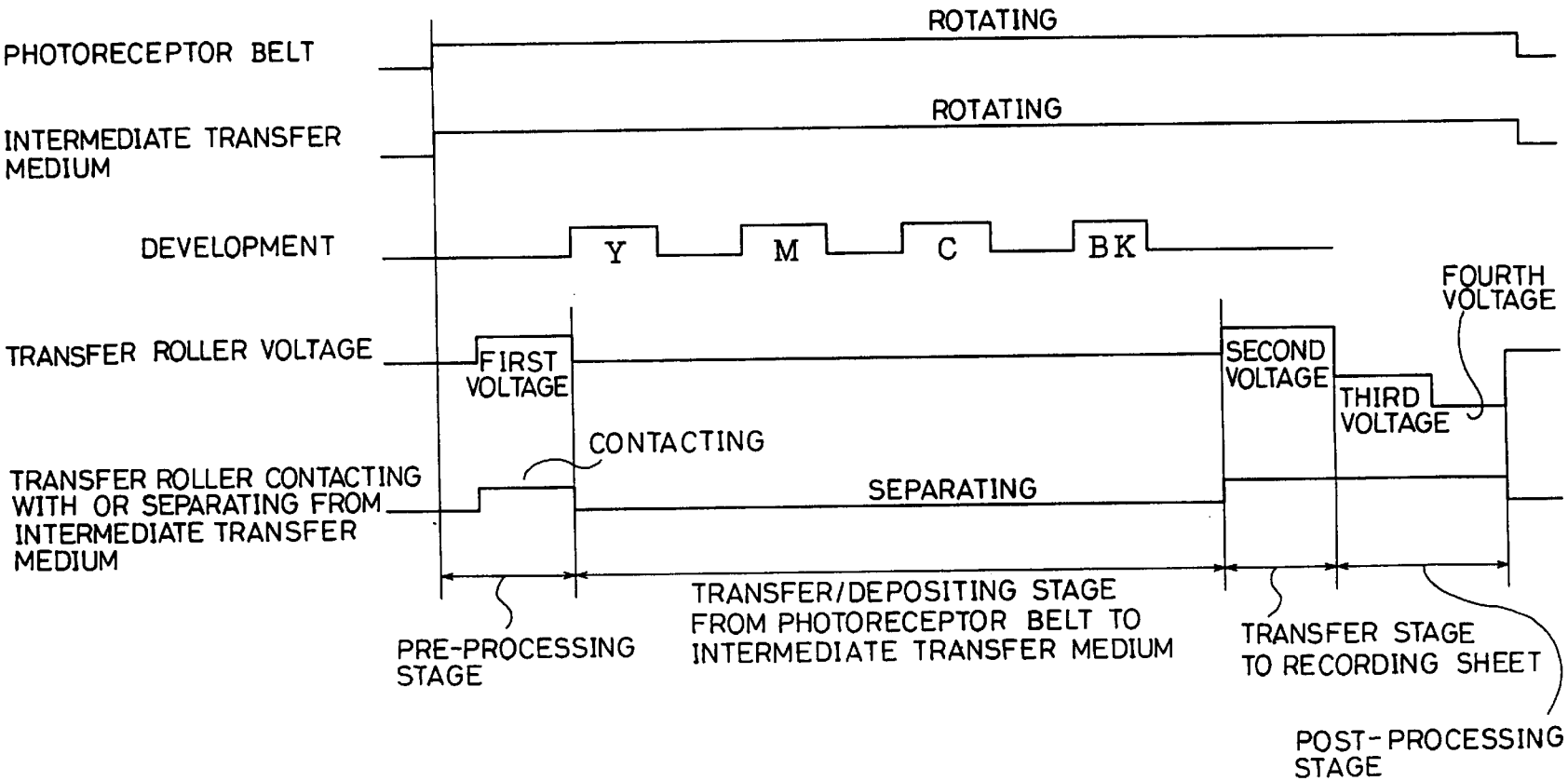
FIG. 12 is a timing chart showing one example of operations of components of the image forming apparatus.

The following describes the operation of the copying machine having the described arrangement referring to FIG. 1, FIG. 2, and FIG. 12. Note that, in the following, a contact between the photoreceptor 7 and the intermediate transfer medium 22 will be referred to as a transfer position X, and a contact between the intermediate transfer medium 22 and the transfer roller 23 will be referred to as a transfer position Y. Also, the explanation will be given through the case where the length of the recording sheet 6 is longer than the distance between the transfer position Y and the transfer position X on the surface of the intermediate transfer medium 22 in the rotation direction of the intermediate transfer medium 22.

First, when the copying machine is turned on, the photoreceptor 7 and the intermediate transfer medium 22 start rotating. Before a toner image is formed on the photoreceptor 7, the waste toner remaining on the outer surface of the photoreceptor 7 is removed by the cleaning device 16, and thereafter the outer surface of the photoreceptor 7 is discharged by the discharge lamp 17. Here, the transfer roller separating solenoid 29 is turned off. As a result, by the effect of the transfer roller contacting spring 28, the transfer roller 23 attached to the supporting member 27 is brought into contact with the intermediate transfer medium 22, and a first voltage in a range of +50 V to +500 V is applied by the power source 23*a* to the intermediate transfer medium 22 via the transfer roller 23 until the development of a first color (for example, yellow) is started, and the first voltage is held on the intermediate transfer medium 22 (pre-processing stage).

Then, after the outer surface of the photoreceptor 7 is charged by the charger 9, the laser scanning unit 1*a* projects a laser beam in accordance with a color image of yellow of a document image onto the outer surface of the photoreceptor 7 via the mirror 1*b* so as to expose and scan the photoreceptor 7. As a result, an electrostatic latent image corresponding to the color image of yellow is formed on the outer surface of the photoreceptor 7.

When the electrostatic image comes to a position to be developed by the developer tank 10 as a result of the rotation of the photoreceptor 7, the developer tank 10 is pressed against the photoreceptor 7 by the developer tank pressing cam 10*a*, and the development is carried out by the developer tank 10. As a result, a toner image of yellow is formed on the photoreceptor 7. Thereafter, the developer tank 10 is pushed back in a direction away from the photoreceptor 7 by the effect of the spring 10*e*, and a predetermined distance is maintained between the photoreceptor 7 and the developer tank 10. Note that, at the start of development by the developer tank 10, the transfer roller separating solenoid 29 is turned on, and the transfer roller 23 is separated from the intermediate transfer medium 22.

When the toner image comes to the transfer position X by the rotation of the photoreceptor 7, because the first voltage having the opposite polarity to that of the toner is held on the intermediate transfer medium 22, the toner image is transferred to the intermediate transfer medium 22 from the photoreceptor 7. Then, the outer surface of the photoreceptor 7 is cleaned again by the cleaning device 16 and is discharged by the discharge lamp 17. The same process of charging, exposure, transfer, and discharge is also carried out with respect to each of the other color images of magenta, cyan, and black. Note that, during this, the transfer roller 23 is kept separated from the intermediate transfer medium 22.

Therefore, by at the maximum of four rotations of the intermediate transfer medium 22, a single full-color image is obtained on the intermediate transfer medium 22. To obtain a monotone image, such as a black-and-white image, from toner of an arbitrary color, only one rotation of the intermediate transfer medium 22 is required. After the toner images of all colors are transferred onto the intermediate transfer medium 22, the color toner image composed of the overlapping toner images is carried to the transfer position Y in accordance with the rotation of the intermediate transfer medium 22.

Meanwhile, in accordance with the above image forming process, in the case of automatic feeding, the recording sheet 6 is sequentially sent out one by one from the top of the sheet feeding cassette 31 by the pickup roller 33 to the aligning rollers 37. In the case of manual feeding, the recording sheet 6 sent out one by one from the manual sheet feeding section 32 and is transported to the aligning rollers 37 by the manual roller 34. Note that, in either case, the recording sheet 6 passes by the sheet presence detecting sensor 35 and the sheet type detecting sensor 36 before reaching the aligning rollers 37 so that the presence or absence of the sheet is judged and the sheet type is detected. The aligning rollers 37 temporarily stop the recording sheet 6 being transported and then transport the recording sheet 6 to the transfer position Y at such a timing that the front end of the color toner image on the intermediate transfer medium 22 and the front end of the recording sheet 6 coincide at the transfer position Y.

When the front end of the color toner image on the intermediate transfer medium 22 and the front end of the recording sheet 6 reach the transfer position Y, the transfer roller separating solenoid 29 is turned off, and the transfer roller 23 is pressed against the intermediate transfer medium 22 via the recording sheet 6, and a second voltage in a range of +100 V to +2000 V is applied by the power source 23*a*. In this manner, by the application of the second voltage having the opposite polarity to that of toner and having larger absolute value than that of the first voltage, the color toner image on the intermediate transfer medium 22 is transferred (second transfer) to the recording sheet 6 (transfer stage).

The recording sheet 6 finished with second transfer is electrostatically removed by the sheet removal charger 24, and is transported to the region between the transfer rollers 39*a* and 39*b* by being guided by the transport guides 30 and 38. The fixing belt 43 suspended by the transfer roller 39*a* and the heat roller 40 is maintained at a predetermined temperature by the ON/OFF control of the heater lamp 40*a*. Therefore, as the recording sheet 6 passes through a region between the fixing belt 43 and the fixing roller 39*b*, the color toner image, which has not been fixed, is fixed on the recording sheet 6 at a predetermined temperature and pressure. Thereafter, the recording sheet 6 is discharged to the discharge tray 45 by the discharge roller 44.

Meanwhile, because the transfer roller separating solenoid 29 remains off after the second transfer, the transfer roller 23 remains contacting the intermediate transfer medium 22. When the second transfer is finished, the power source 23*a* applies the third voltage in a range of −500 V to +1500 V to the transfer roller 23. As a result, the toner adhered to the transfer roller 23 in the second transfer is transferred (third transfer) to the intermediate transfer medium 22 at the transfer position Y (post-processing stage).

After the third transfer, the power source 23*a* applies the fourth voltage in a range of −50 V to −500 V to the transfer roller 23. As a result, the waste toner remaining on the intermediate transfer medium 22 is transferred (fourth transfer) to the photoreceptor 7 at the transfer position X (post-processing stage).

When the fourth transfer is finished, the photoreceptor 7 and the intermediate transfer medium 22 stop rotating, and the transfer roller separating solenoid 29 is turned on, and the transfer roller 23 is separated from the intermediate transfer medium 22.

Note that, the first through fourth voltages are set in accordance with the sheet type, etc., of the recording sheet 6 by the control of the CPU 47.

As described, in the present embodiment, the first transfer and second transfer are carried out by the transfer roller 23, not by a transfer charger employing corona discharge, thus ensuring that less ozone is generated compared with the conventional case. Therefore, it is possible to provide a copying machine which causes almost no harmful effect on the human body and is environmentally friendly. Also, since the described transfers are carried out by a single transfer roller 23 and a single power source 23*a*, the number of components are much less than it had been required conventionally, thereby realizing a small copying machine.

Further, the transfer roller 23 is brought into contact with the intermediate transfer medium 22 only in the pre-processing stage, transfer stage, and the post-processing stage, and is separated from the intermediate transfer medium 22 in other times. This prevents filming on the surface of the intermediate transfer medium 22 and also prevents a visualized toner image from being transferred to the transfer roller 23 by pressure. As a result, the toner image to be transferred to the recording sheet 6 is prevented from being disturbed and the image quality is improved with certainty. Note that, filming is a phenomenon in which the toner sticks to the intermediate transfer medium 22 by being stretched over at the contact between the transfer roller 23 and the intermediate transfer medium 22 as a result of continuous contact between these two members.

Also, as described, because the voltage applied to the transfer roller 23 by the power source 23*a* is in accordance with the pre-processing stage, transfer stage, and post-processing stage, it is ensured that the transfer efficiency is improved in each of the above stages.

Further, because the first voltage and second voltage have the opposite polarity to that of the toner, and because the second voltage is higher than the first voltage, it is ensured that the second transfer is carried out when a transition is made from the first transfer to the second transfer. Also, because the third voltage and fourth voltage have the same polarity as that of toner, or are voltages that are shifted from the side of the polarity of the second voltage to the side of the polarity of the toner, and because the fourth voltage is higher than the third voltage, it is ensured that the toner is transferred in the order of the transfer roller 23, the intermediate transfer medium 22, and the photoreceptor 7.

Note that, in the post-processing stage, the third transfer and fourth transfer may be carried out simultaneously. In such a case, even though the third voltage and forth voltage are set to the same voltage in a range of, for example, −50 V to −500 V, the third transfer and fourth transfer are carried out appropriately. Also, by carrying out the third transfer and fourth transfer simultaneously, the processing time of the post-processing stage is reduced, allowing a quick response to the next image forming process. Note that, a mode in which the fourth transfer is carried out after the third transfer and a mode in which the third transfer and the fourth transfer are carried out simultaneously are selectable.

Before the first transfer, and in the third transfer and fourth transfer, the power source 23*a* applies a predetermined voltage to the transfer roller 23 for a duration longer than one rotation of the intermediate transfer medium 22. This ensures in the third transfer that the toner remaining on the transfer roller 23 is transferred back to the intermediate transfer medium 22. Also, in the fourth transfer, it is ensured that the toner remaining on the intermediate transfer medium 22 is transferred back to the photoreceptor 7. As a result, in the subsequent first transfer, the entire surface of the intermediate transfer medium 22 is uniformly charged, thus substantially completely eliminating transfer nonuniformity of the toner image on the intermediate transfer medium 22. Therefore, with the described arrangement, the toner image is transferred uniformly from the front end to the rear end of the recording sheet 6. Note that, in the third transfer, it is sufficient when the power source 23*a* applies a predetermined voltage to the transfer roller 23 for a duration longer than one rotation of the transfer roller 23.

Further, after the second transfer, the transfer roller 23 is not separated from the intermediate transfer medium 22, and the third transfer and fourth transfer are carried out successively, thus simplifying the separating-contacting control of the transfer roller 23.

As described, in the present embodiment, the transfer roller 23 carries out both transfers of (a) the transfer between the photoreceptor 7 and the intermediate transfer medium 22 and (b) the transfer between the intermediate transfer medium 22 and the recording sheet 6.

After the fourth transfer, when the intermediate transfer medium 22 and the transfer roller 23 are kept contacted with each other, the contact between these two members are deformed by the pressing force exerted on one another. However, in the present embodiment, because the transfer roller 23 is separated from the intermediate transfer medium 22 after the fourth transfer, deformation of the intermediate transfer medium 22 and the transfer roller 23 is prevented.

Further, as described, by the separating-contacting operation of the transfer roller 23 and by the application of a voltage by the power source 23*a*, the waste toner is all transferred to the photoreceptor 7 and remains only on the outer surface of the photoreceptor 7. Therefore, it is not required to provide the cleaning device 26 for cleaning the surface of the intermediate transfer medium 22 and means to clean the surface of the transfer roller 23. That is, the only cleaning device required in the copying machine main body is the cleaning device 16 for cleaning the photoreceptor 7. As a result, the number of components is reduced, thus reducing the size of the copying machine and the costs. Also, since only one cleaning device is provided, scattering of toner in the copying machine is reduced.

Figure 13:
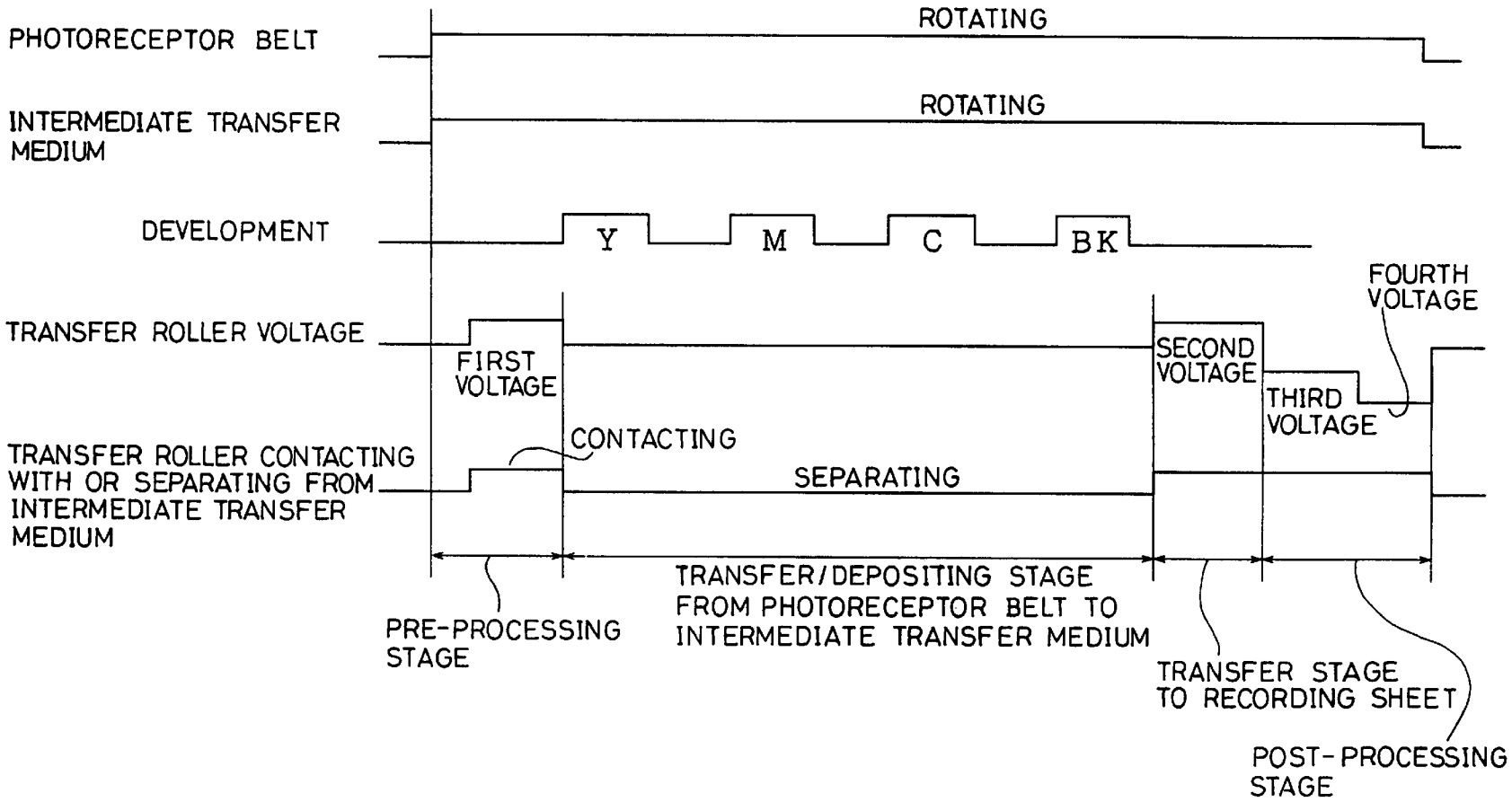
FIG. 13 is a timing chart showing another example of operations of components of the image forming apparatus.

Note that, in the present embodiment, as shown in FIG. 12, the transfer roller 23 is pressed against the intermediate transfer medium 22 and the power source 23*a* applies a predetermined second voltage when the toner image of black is transferred to the intermediate transfer medium 22 and the front end of the color toner image on the intermediate transfer medium 22 reaches the transfer position Y. However, as shown in FIG. 13, it is possible alternatively to press the transfer roller 23 against the intermediate transfer medium 22 and to apply the predetermined second voltage by the power source 23*a* immediately after the development of black is finished. This may be carried out when the length of the recording sheet 6 is shorter than the distance between the transfer position Y and the transfer position X on the surface and in the rotation direction of the intermediate transfer medium 22.

The following will describe a detailed structure of the sheet type detecting section 36 of the present embodiment.

Figure 14:
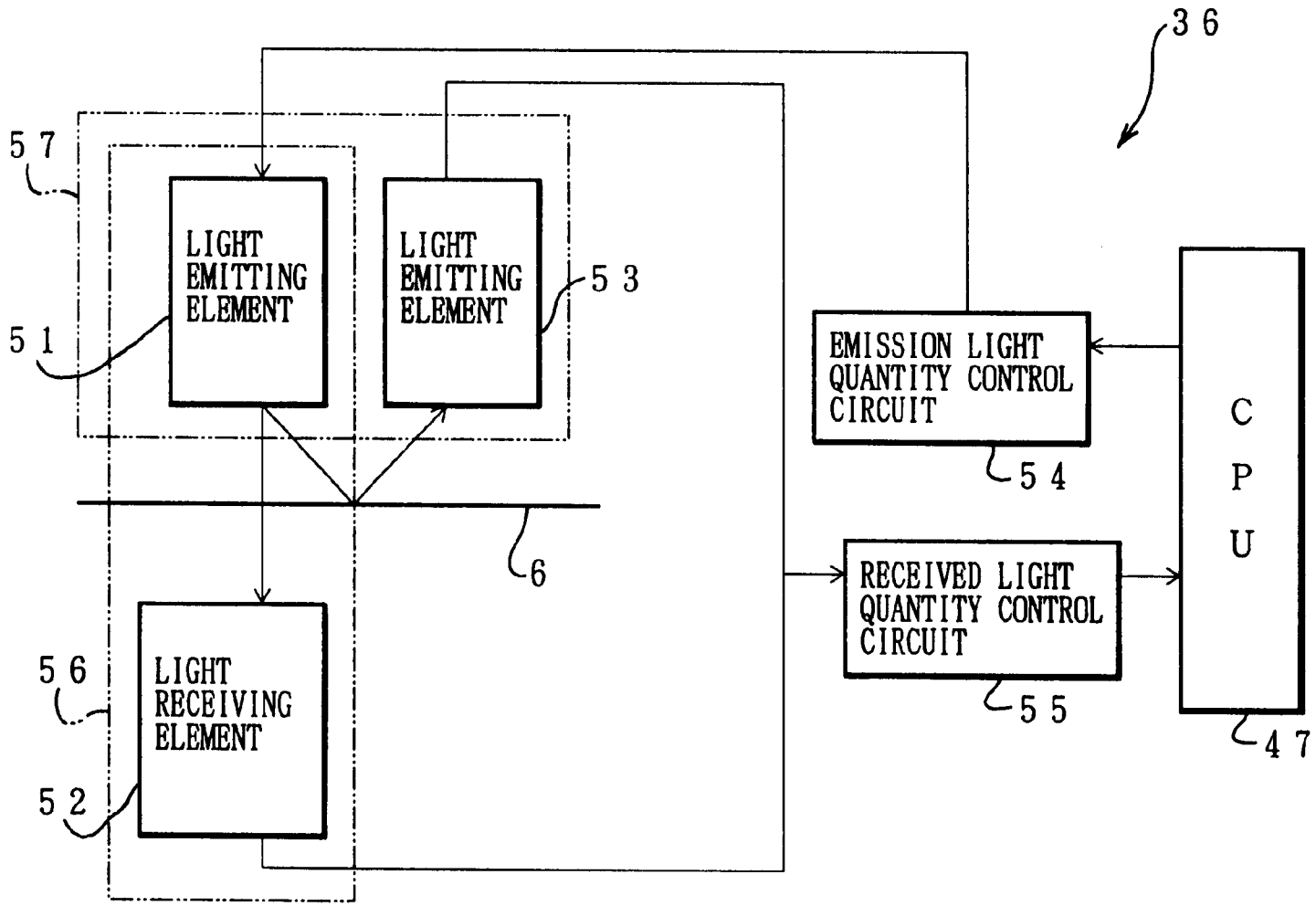
FIG. 14 is an explanatory drawing showing a detailed structure of a sheet type detecting section of the image forming apparatus.

As shown in FIG. 14, the sheet type detecting section 36 optically detects the type (transparency, thickness, length, color, etc.) of the recording sheet 6 transported to the transfer section 3, and is composed of the light emitting element 51, light receiving elements 52 and 53, an emittion light quantity control circuit 54, and a received light quantity control circuit 55.

The light receiving element 52 is positioned such that the light receiving element 52 can receive the light emitted from the light emitting element 51 and transmitted through the recording sheet 6. Thus, the light emitting element 51 and the light receiving element 52 constitute a transmissive sensor 56. The light receiving element 53 is positioned such that the light receiving element 53 can receive the light emitted from the light emitting element 51 and reflected off the upper surface of the recording sheet 6. Thus, the light emitting element 51 and the light receiving element 53 constitute a reflective sensor 57. Namely, in the present embodiment, the transmissive sensor 56 and the reflective sensor 57 are used in combination. Note that, the light receiving element 53 of the reflective sensor 57 is composed of, for example, a CCD (Charge Coupled Device) capable of recognizing the color of the recording sheet 6.

The emittion light quantity control circuit 54 controls the amount of light emitted by the light emitting element 51, in accordance with a control signal from the CPU 47. The received light quantity control circuit 55 sends signals corresponding to the amount of light received by the light receiving elements 52 and 53, respectively, to the CPU 47.

Figure 15:
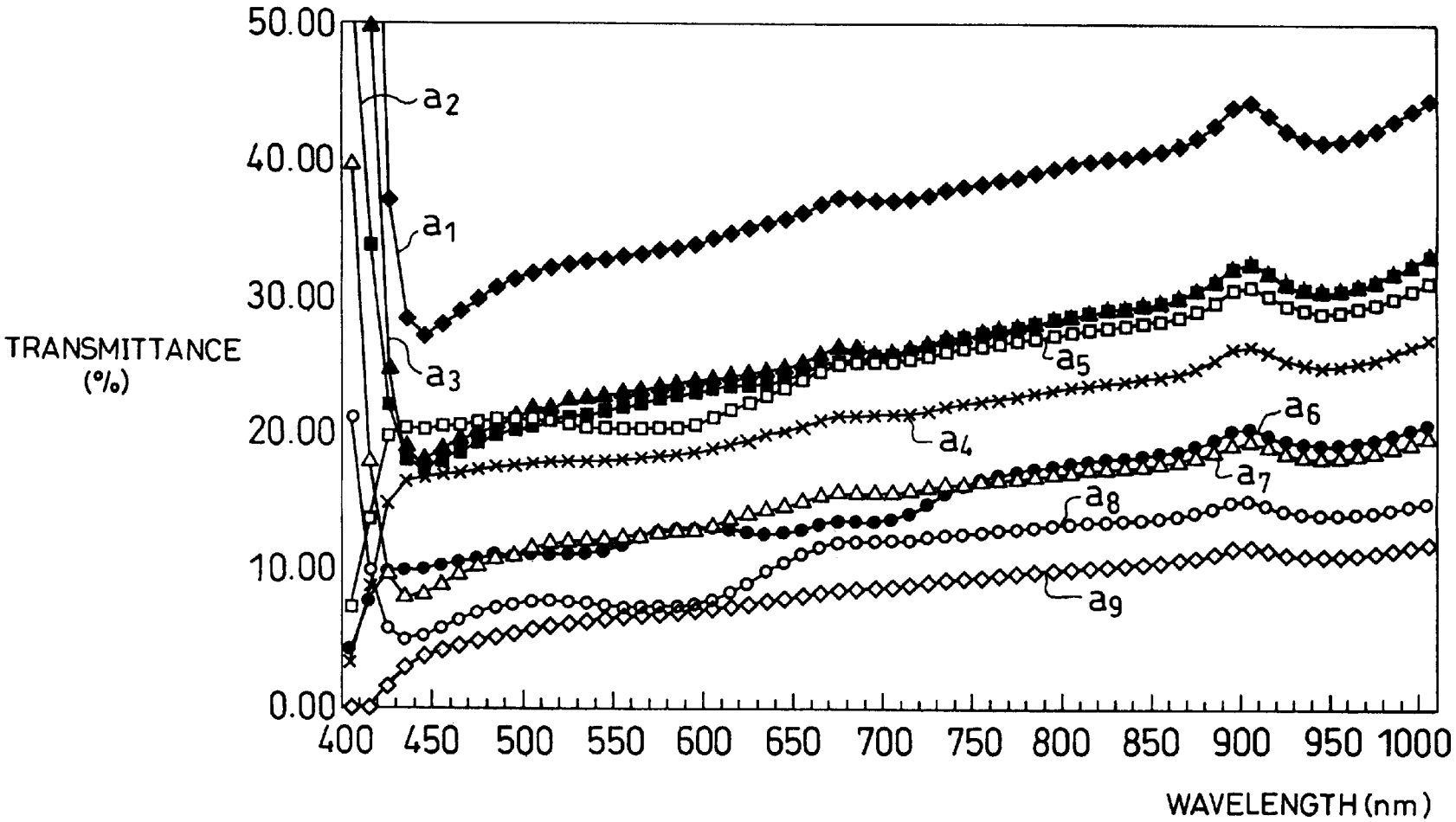
FIG. 15 is a graph showing a relationship between wavelength of light emitted from a light emitting element of the sheet type detecting section and transmittance for various types of recording sheet.

FIG. 15 shows a relationship between wavelength and transmittance of light emitted from the light emitting element 51. In FIG. 15, the curve $a_1$ connecting "◆", the curve $a_2$ connecting "■", the curve $a_3$ connecting "▲", the curve $a_4$ connecting "×", the curve $a_5$ connecting "□", the curve $a_6$ connecting "●", the curve $a_7$ connecting "Δ", the curve $a_8$ connecting "○", the curve $a_9$ connecting "◇" represent the wavelength vs. transmittance relationship when the recording sheet 6 is a sheet of paper having a basis weight (mass per unit area) of 52 g/m$^2$, 60 g/m$^2$ (#1), 60 g/m$^2$ (#2), 80 g/m$^2$ (#1), 80 g/m$^2$ (#2), 100 g/m$^2$, 128 g/m$^2$, 184 g/m$^2$, and an envelope, respectively. It can be seen from FIG. 15 that the transmittance of light is different depending on the basis weight of the recording sheet 6 and the wavelength of the light.

Note that, a common domestic envelope is made by laminating two to four sheets of paper each having a basis weight of 50 g/m$^2$ to 60 g/m$^2$, and a common air mail envelope is made by laminating 7 or so sheets of paper each having a basis weight in the range of 50 g/m$^2$ to 60 g/m$^2$. Therefore, a domestic envelope is equivalent of a sheet of paper having a basis weight of 100 g/m$^2$ to 240 g/m$^2$, and an air mail envelope is equivalent of a sheet of paper having a basis weight of 350 g/m$^2$ to 420 g/m$^2$. The envelope used in the present embodiment is equivalent of a sheet of paper having a basis weight of 240 g/m$^2$.

As shown in FIG. 15, when the wavelength of light is in a range of 400 nm to 760 nm, there is a case where the same transmittance is obtained at a predetermined wavelength even when the basis weight of the recording sheet 6 is different. Thus, when the wavelength of light is in this range, it is impossible to detect the basis weight of the recording sheet 6 by detecting the transmittance, namely the thickness of the recording sheet 6 cannot be detected. In contrast, when the wavelength of light is 800 nm or longer, the transmittance and the wavelength correspond to each other one to one. Therefore, in this case, it is possible to detect the basis weight of the recording sheet 6 by detecting the transmittance. This is clear from the graphs of FIG. 16 and FIG. 17.

Figure 16:
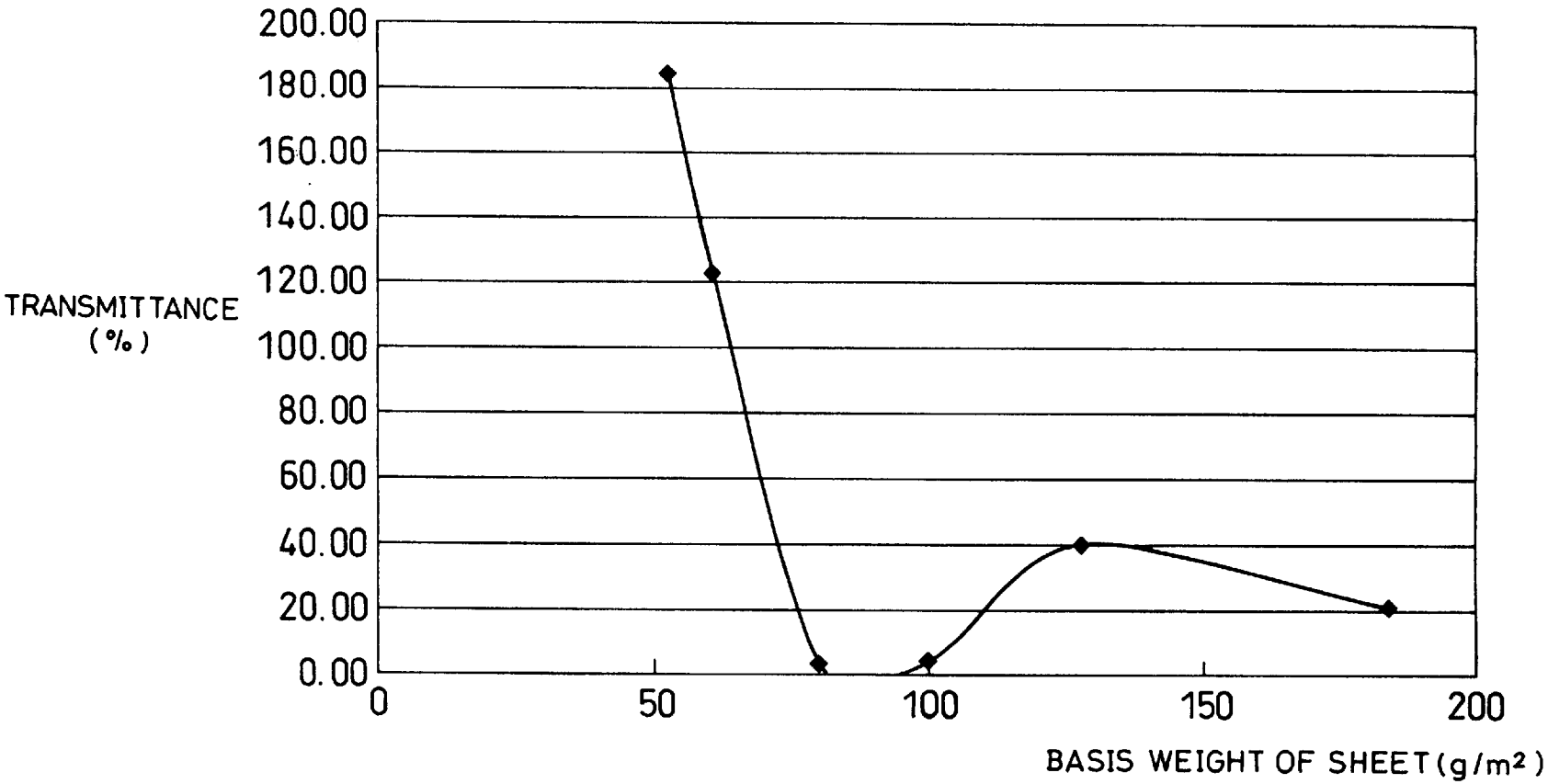
FIG. 16 is a graph showing a relationship between basis weight of a recording sheet and transmittance at a predetermined wavelength of light.
Figure 17:
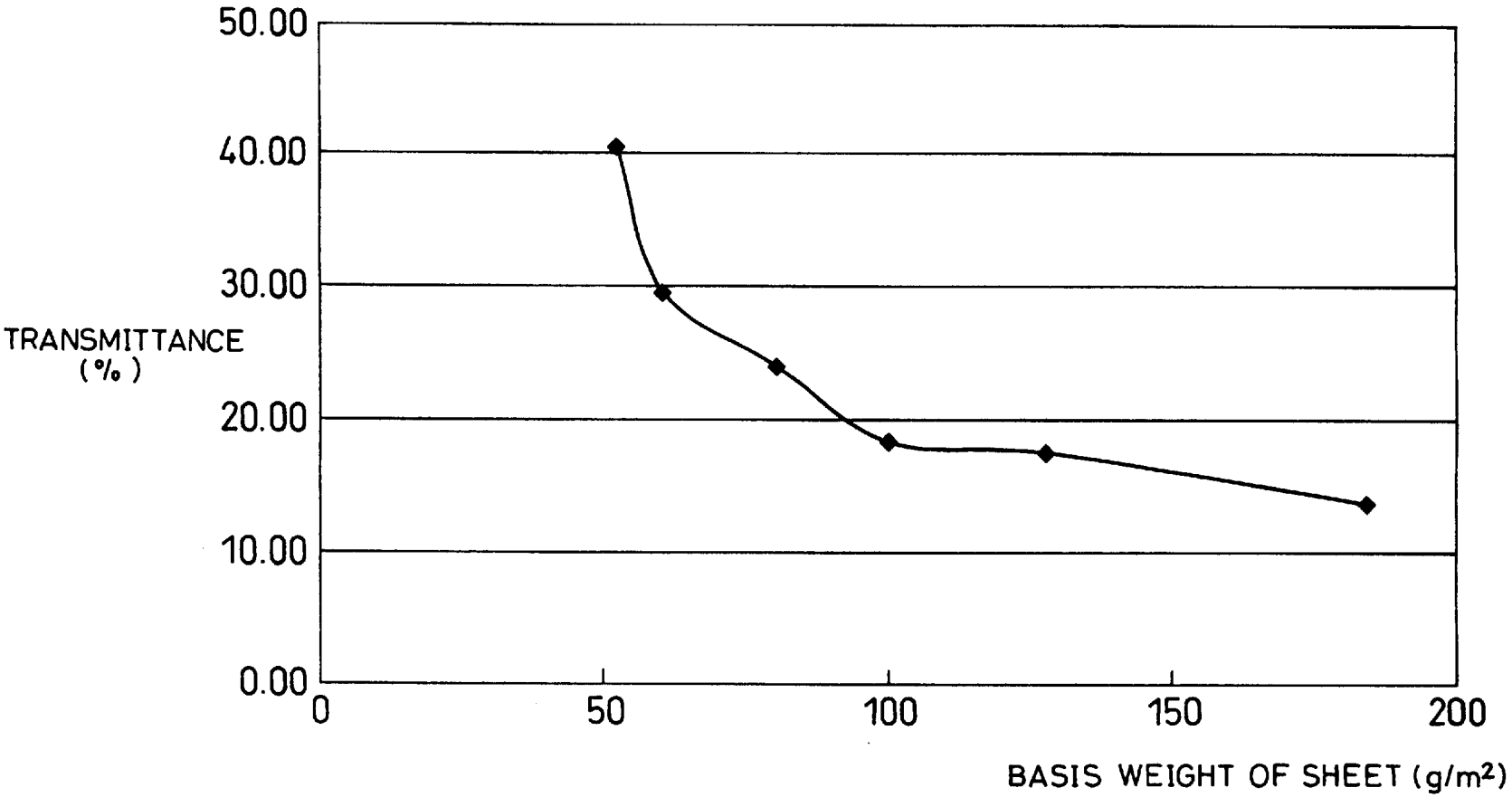
FIG. 17 is a graph showing a relationship between basis weight of a recording sheet and transmittance at a wavelength of light different from that of FIG. 16.

FIG. 16 shows a relationship between the basis weight of the recording sheet 6 and transmittance when the wavelength of the light emitted from the light emitting element 51 is 400 nm. As shown in FIG. 16, there is a case where the same transmittance is obtained at two or more types of the recording sheet 6 having different basis weights. Thus, in some cases, the basis weight of the recording sheet 6 cannot be decided depending on the transmittance. In contrast, FIG. 17 shows a relationship between the basis weight of the recording sheet 6 and transmittance when the wavelength of light is 840 nm. In this case, the transmittance and the wavelength correspond to each other one to one.

Therefore, with a wavelength of light of 800 nm or longer, by measuring the transmittance of the light transmitted through the recording sheet 6, it is possible to discriminate from one another the types of the recording sheet 6 having a basis weight in a range of 40 g/m$^2$ to 300 g/m$^2$.

Specifically, from the graph of FIG. 17, the recording sheet 6 is decided to have a basis weight in a range of 50 g/m$^2$ to 100 g/m$^2$ when the transmittance is not less than 18 percent, and to have a basis weight in a range of 100 g/m$^2$ to 150 g/m$^2$ when the transmittance is in a range of not less than 16 percent to less than 18 percent. Also, from the slope of the graph of FIG. 17, it is possible decide that the recording sheet 6 has a basis weight in a range of 40 g/m$^2$ to 100 g/m$^2$ when the transmittance is not less than 18 percent, 150 g/m$^2$ to 200 g/m$^2$ when the transmittance is in a range of not less than 12 percent to less than 16 percent, 200 g/m$^2$ to 250 g/m$^2$ when the transmittance is in a range of not less than 10 percent to less than 12 percent, and 250 g/m$^2$ to 300 g/m$^2$ when the transmittance is less than 10 percent.

Note that, when the recording sheet 6 is the OHP film, the light emitted from the light emitting element 51 completely transmits through the recording sheet 6. Meanwhile, when the recording sheet 6 has a small basis weight, that is, when the recording sheet 6 is extremely thin, the light also transmits through the recording sheet 6 substantially completely. Therefore, in the arrangement where only the transmissive sensor 56 is provided, although it is still possible to discriminate whether the recording sheet 6 is the OHP film or a thin non-transparent sheet, the discrimination is error-bound.

As a countermeasure, in the present embodiment, the transmissive sensor 56 is used in conjunction with the reflective sensor 57. The light receiving element constituting the reflective sensor 57 detects the amount of light, from the light emitting element 51, reflected off the upper surface of the recording sheet 6, and sends the detection signal to the CPU 47 via the received light control circuit 55. In response to this, when the amount of light is substantially zero, the CPU 47 decides that the recording sheet 6 is the OHP film, and when the amount of light is not substantially zero, the CPU 47 decides that the recording sheet 6 is a non-transparent sheet.

In this manner, by the provision of both the transmissive sensor 56 and the reflective sensor 57, it is ensured that the thickness of the recording sheet 6 is detected, and that the OHP film and a thin non-transparent sheet are discriminated from each other. Further, since the reflective sensor 57 is also capable of detecting the color of the recording sheet 6, with the described arrangement of the sheet type detecting section 36, it is possible to discriminate from one another the types of the recording sheet 6 having different transparency, thickness, and color, etc.

The length of the recording sheet 6 can be detected by detecting the transport speed of the recording sheet 6 and the time required for the recording sheet 6 to pass through the sheet type detecting section 36. The transport time is detected by reading a change in transmittance and reflectance by taking the advantage of the fact that the transmittance and reflectance are different, for example, at the front end and rear end of the recording sheet 6.

Figure 18:
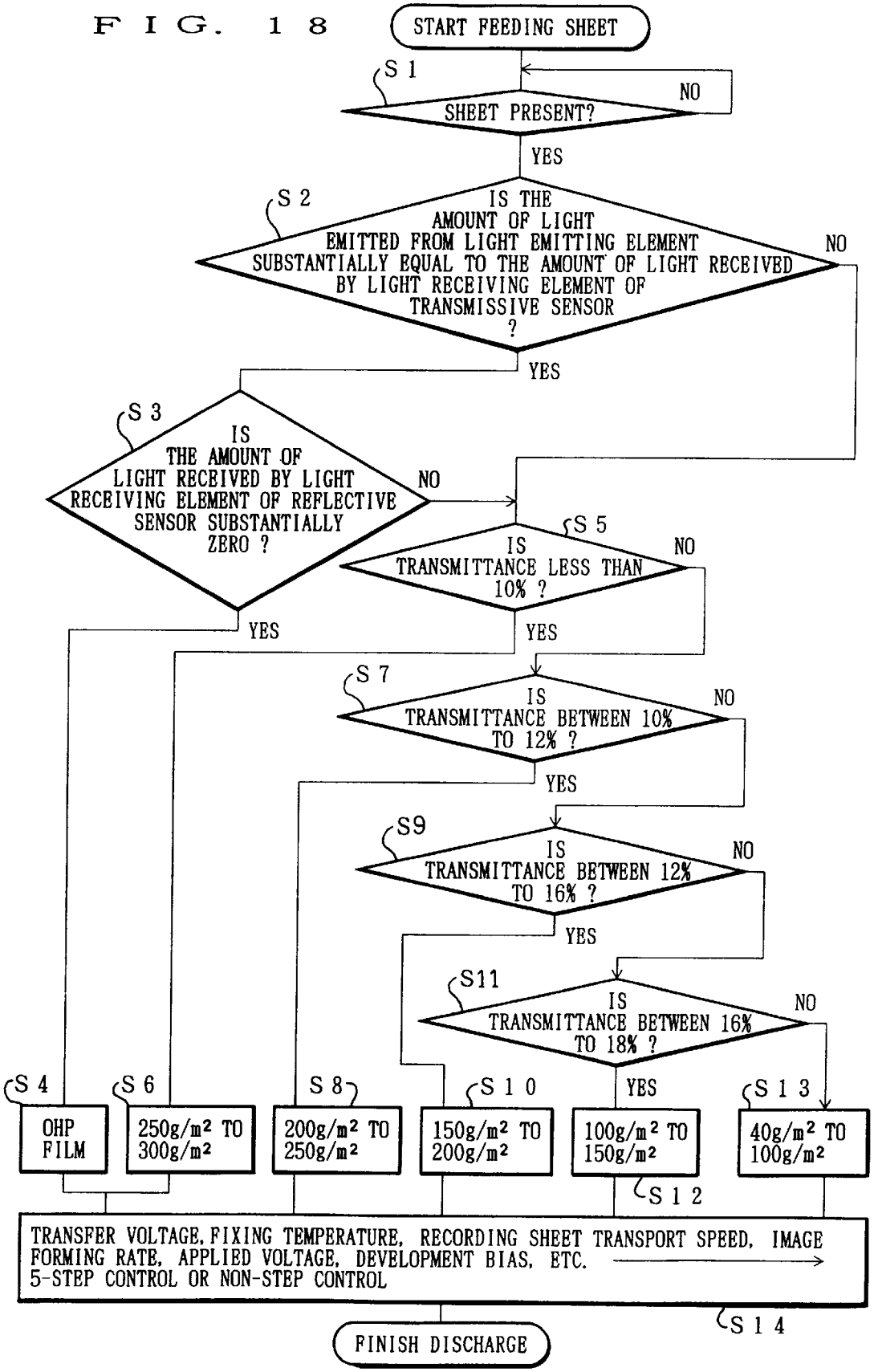
FIG. 18 is a flowchart showing a control of the CPU in accordance with a detection signal from the sheet type detecting section.

The following will describe a control operation of the CPU 47 in accordance with a detection signal from the sheet type detecting section 36 referring to the flowchart of FIG. 18. Note that, the steps are abbreviated to "S". Also, the explanation is based on the case where the wavelength of the emitted light from the light emitting element 51 is 840 nm.

First, when the recording sheet 6 is fed from the sheet feeding cassette 31 or from the manual sheet feeding section 32, and the sheet presence detecting sensor 35 detects the presence of the recording sheet 6 (S1), the CPU 47 decides whether the amount of light (first light quantity hereinafter) emitted from the light emitting element 51 and the amount of light (second light quantity hereinafter) received by the light receiving element 52 are substantially equal to each other (S2). When it is decided that the first light quantity and the second light quantity are substantially equal in S2, it is decided whether the light received by the light (third light quantity hereinafter) receiving element 53 is substantially zero (S3). When the third light quantity is decided to be zero in S3, the CPU 47 decides that the recording sheet 6 is the OHP film (S4).

In this manner, by examining the difference between the first and second light quantities and the third light quantity, the CPU 47 decides whether the recording sheet 6 is the OHP film or a common non-transparent sheet. Here, S2 may be carried out before S3; nevertheless, the transparency of the recording sheet 6 is decided more quickly when S2 is carried out before S3. Note that, in the following, the recording sheet 6 of the OHP film will be referred to as the recording sheet 6 of group 1.

Thereafter, when the first light quantity and the second light quantity are not substantially equal in S2, or when the third light quantity is not substantially zero in S3, the CPU 47 decides whether the transmittance based on the difference between the first light quantity and the second light quantity is less than 10 percent (S5). When the transmittance is decided to be less than 10 percent in S5, the CPU 47 decides that the recording sheet 6 has a basis weight in a range of 250 g/m$^2$ to 300 g/m$^2$ (S6). Note that, in the following, the recording sheet 6 having a basis weight of less than 10 percent will also be referred to as the recording sheet 6 of group 1, as with the OHP film.

When the transmittance is not less than 10 percent in S5, the CPU 47 decides whether the transmittance is in a range of 10 percent to 12 percent (S7). When the transmittance is in this range in S7, the CPU 47 decides that the recording sheet 6 has a basis weight in a range of 200 g/m$^2$ to 250 g/m$^2$ (S8). Note that, in the following, the recording sheet 6 having a basis weight in this range will be referred to as the recording sheet 6 of group 2.

When the transmittance is outside the above range in S7, the CPU 47 decides whether the transmittance is in a range of 12 percent to 16 percent (S9). When the transmittance is in this range in S9, the CPU 47 decides that the recording sheet 6 has a basis weight in a range of 150 g/m$^2$ to 200 g/m$^2$ (S10). Note that, in the following, the recording sheet 6 having a basis weight in the above range will be referred to as the recording sheet 6 of group 3.

When the recording sheet 6 is outside the above range in S9, the CPU 47 decides whether the transmittance is in a range of 16 percent to 18 percent (S11). When the transmittance is in this range in S11, the CPU 47 decides that the recording sheet 6 has a basis weight in a range of 100 g/m$^2$ to 150 g/m$^2$ (S12). Note that, in the following, the recording sheet 6 having a basis weight in the above range will be referred to as the recording sheet 6 of group 4. On the other hand, when the transmittance is outside the above range in S11, the CPU 47 decides that the recording sheet 6 has a basis weight in a range of 40 g/m$^2$ to 100 g/m$^2$ (S13). Note that, in the following, the recording sheet 6 having a basis weight in the above range will be referred to as the recording sheet 6 of group 5.

Then, the CPU 47 carries out a control of various parameters for each of the groups 1 through 5 (S14). The various parameters include the transfer voltage applied to the transfer roller 23 by the power source 23*a*, the voltage of the power source 24*a* applied to the sheet removal charger 24, a development bias voltage, a voltage for charging the photoreceptor 7, the temperature of the heater lamp 40*a*, the rotational speed of the driving motor 48 for driving the fixing rollers, the quantity of light emitted from the light emitting element 51 of the sheet type detecting section 36, the image forming rate, and the transport speed of the recording sheet 6, etc., which are controlled individually or in combination with optimum conditions. As a result, a predetermined printing quality in accordance with the sheet type of the recording sheet 6 is obtained.

The following will describe a control of transfer voltage by the CPU 47, as an example of the parameter control in S 14. Note that, the same principle also applies to the control of other parameters.

Figure 19:
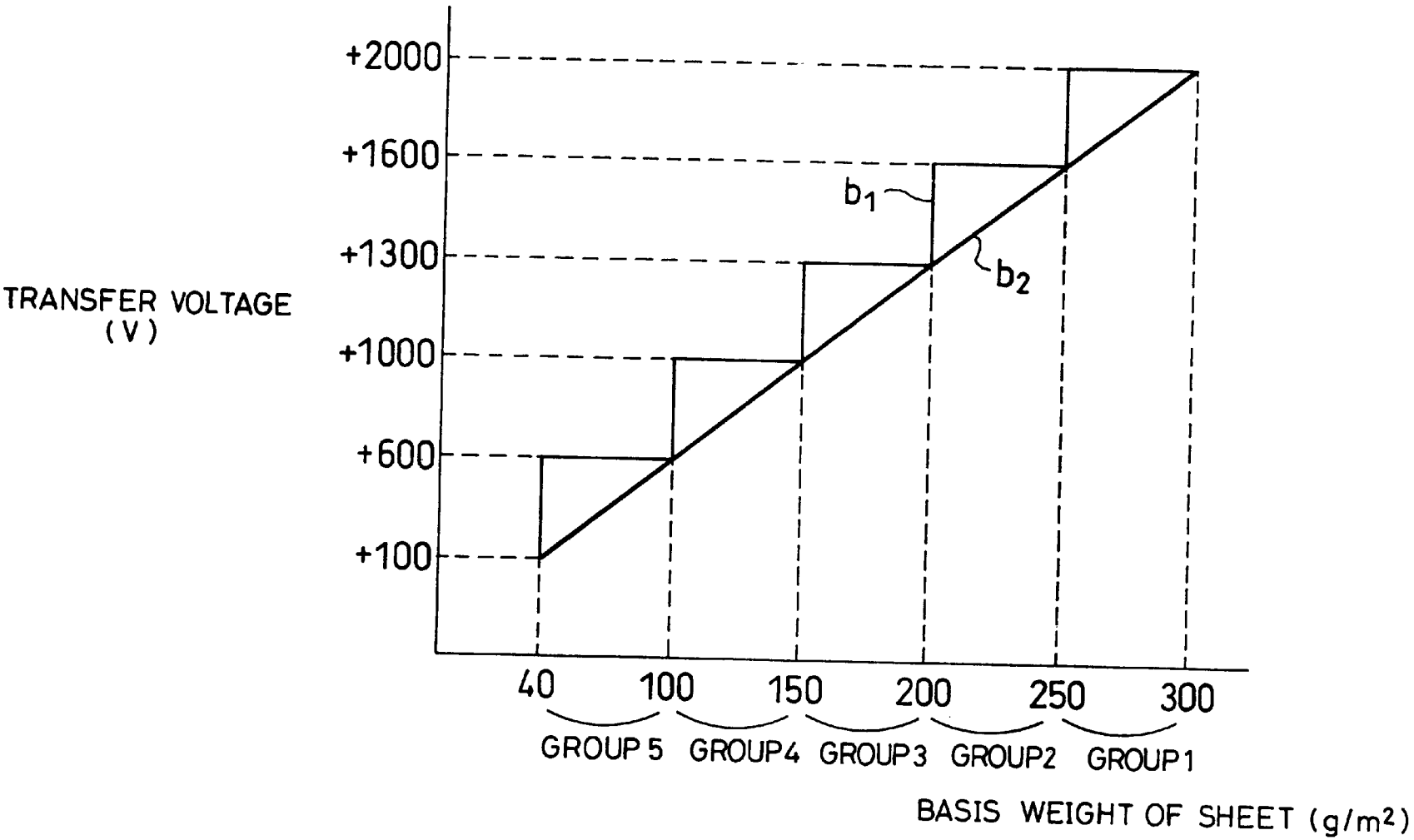
FIG. 19 is a graph showing a relationship between basis weight of a recording sheet and transfer voltage applied in accordance with the basis weight.

FIG. 19 shows a relationship between the basis weight of the recording sheet 6 and, for example, the second voltage applied to the transfer roller 23 by the power source 23*a*. The CPU 47 controls the power source 23*a* so that the power source 23*a* applies the second voltage of, for example, as shown by the solid line $b_1$ in FIG. 19, +600 V, +1000 V, +1300 V, +1600 V, and +2000 V to the recording sheet 6 of group 5, group 4, group 3, group 2, and group 1, respectively to the transfer roller 23.

Figure 20:
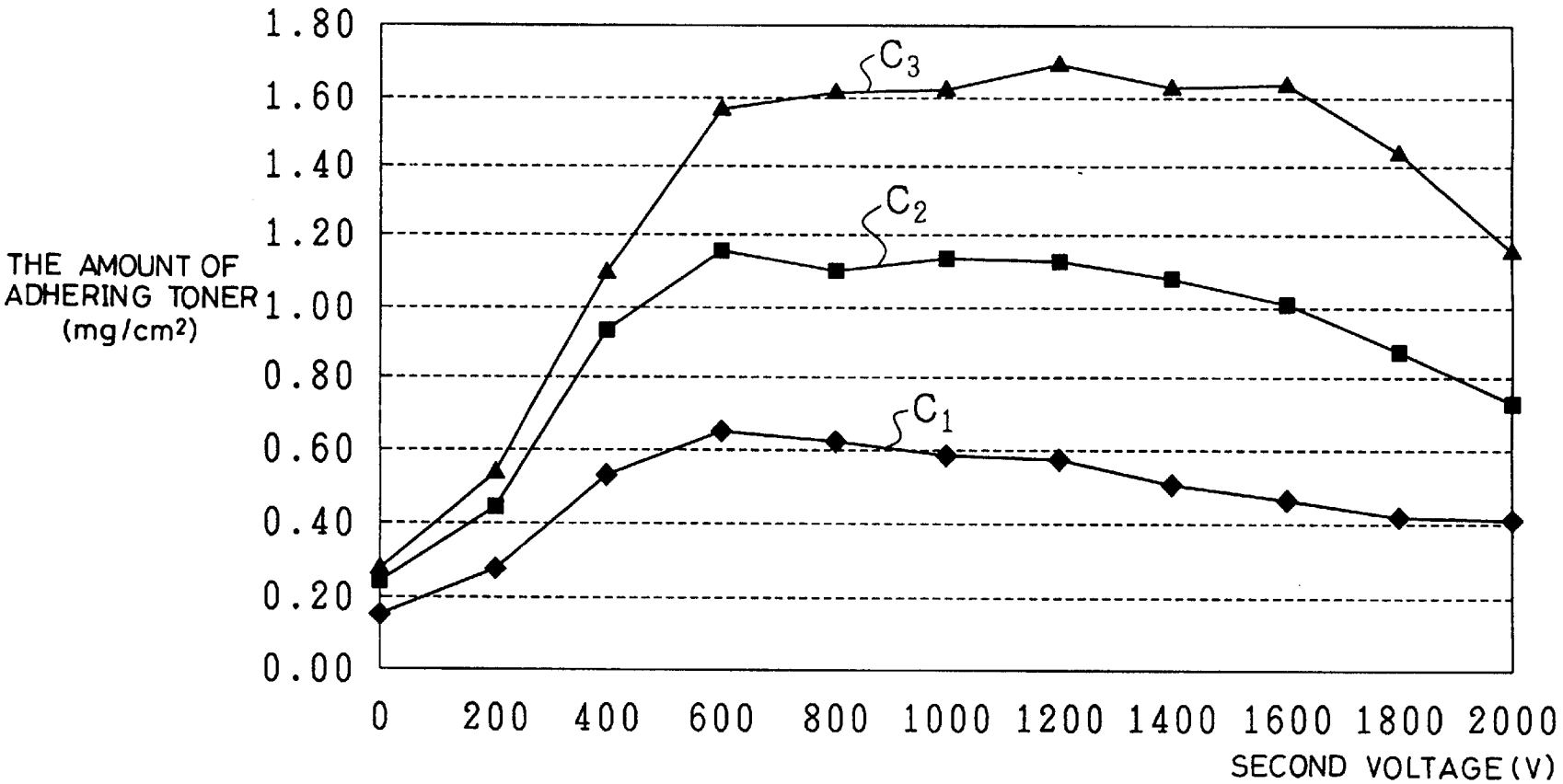
FIG. 20 is a graph showing a relationship between transfer voltage and the amount of adhering toner with respect to a recording sheet having a predetermined basis weight.
Figure 21:
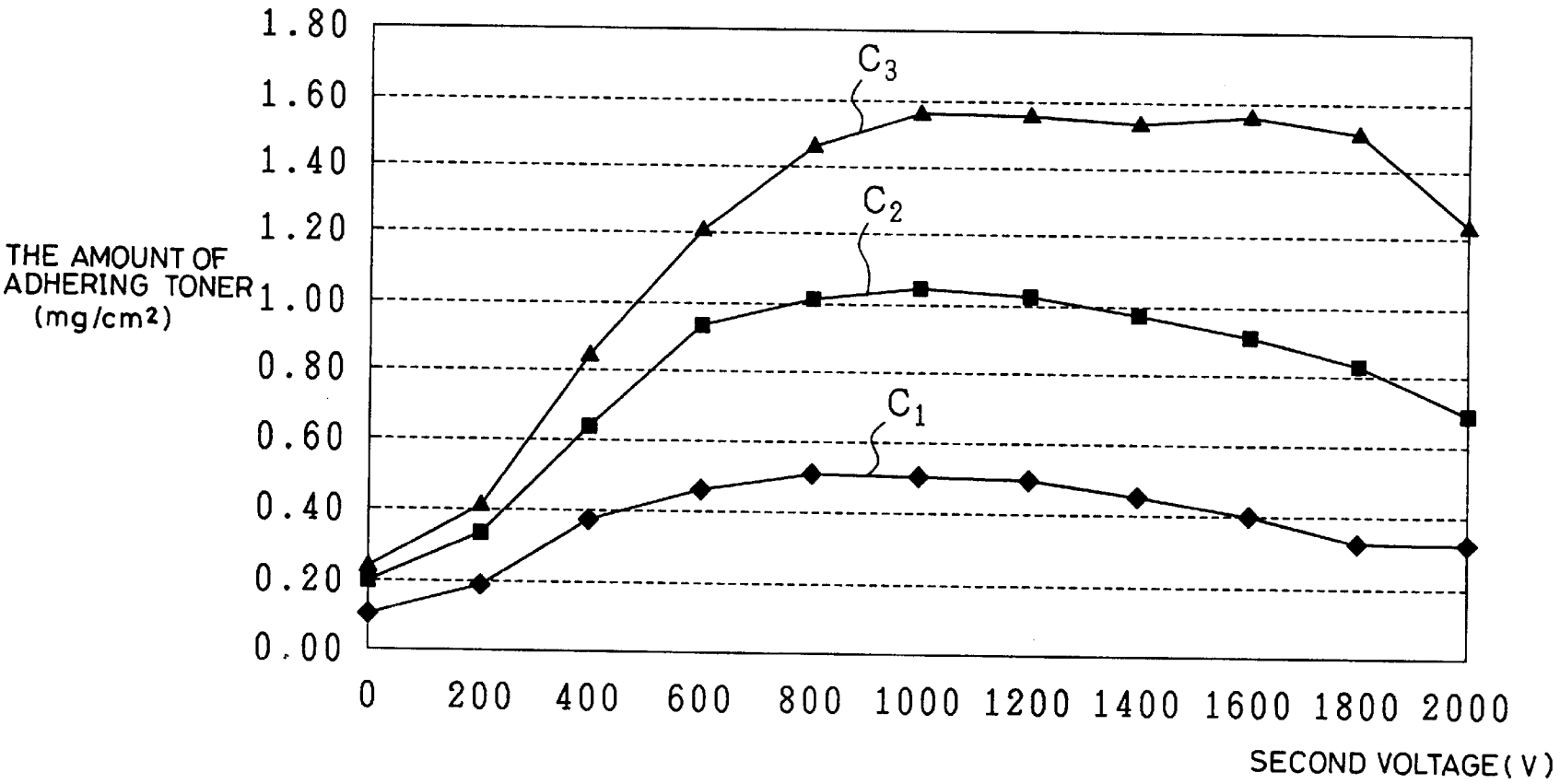
FIG. 21 is a graph showing a relationship between transfer voltage and the amount of adhering toner with respect to a recording sheet having a basis weight different from that of FIG. 20.
Figure 22:
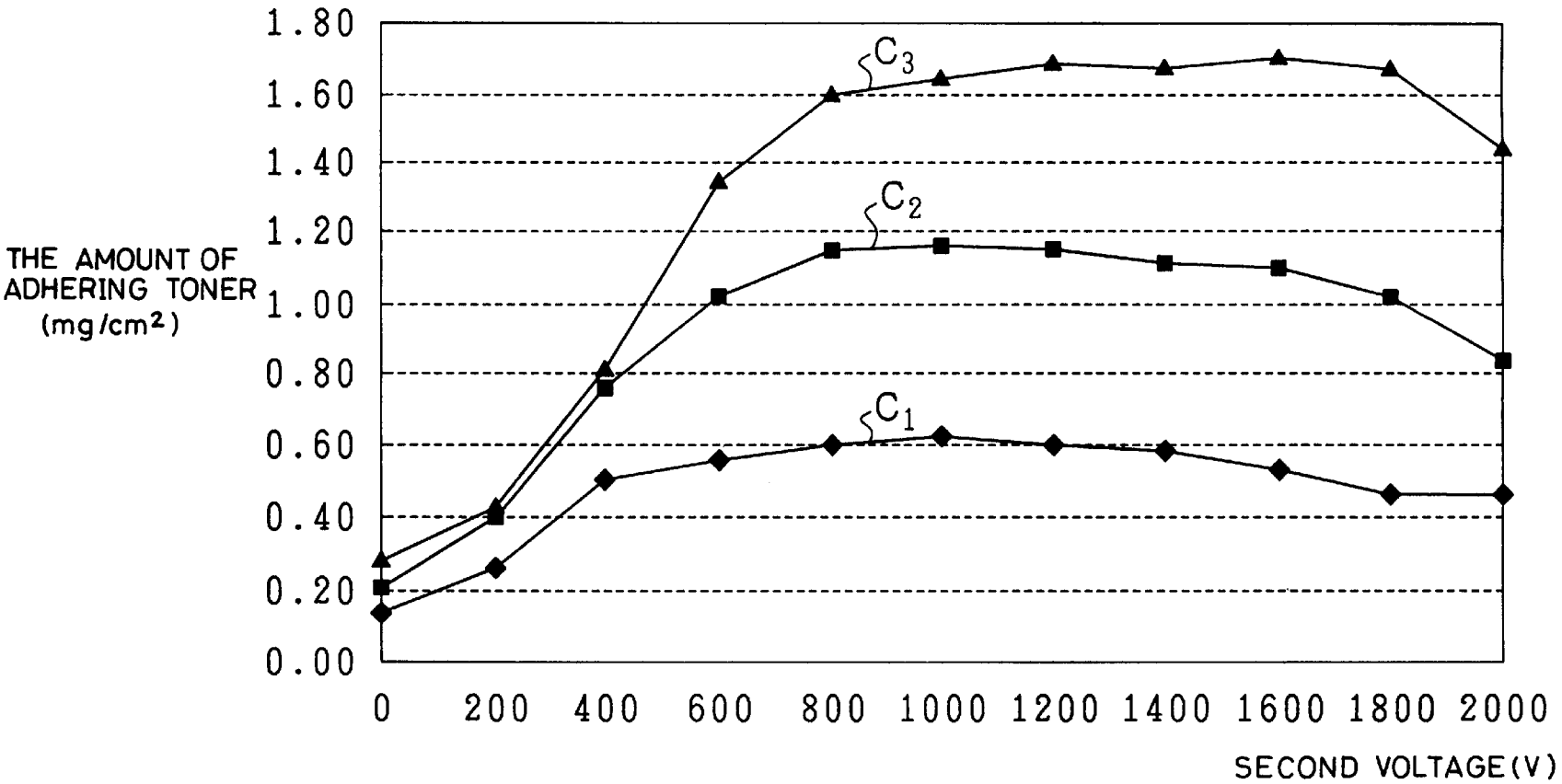
FIG. 22 is a graph showing a relationship between transfer voltage and the amount of adhering toner with respect to a recording sheet having a basis weight different from that of FIG. 20 and FIG. 21.

FIG. 20 through FIG. 22 are graphs for accessing whether the voltage applied in accordance with the sheet type of the recording sheet 6 is appropriate. FIG. 20 through FIG. 22 show a relationship between second voltage and the amount of adhering toner when the recording sheet 6 has a basis weight of 90 g/m$^2$, 128 g/m$^2$, and 184 g/m$^2$, respectively. In FIG. 20 through FIG. 22, the curve $c_1$ connecting "◆", the curve $c_2$ connecting "■", and the curve $c_3$ connecting "▲" represent toner layers of cyan (only one layer of cyan), green (two layers of magenta and cyan), and black (three layers of yellow, magenta, and cyan), respectively.

In FIG. 20 through FIG. 22, a portion of the curves steeply ascending to the right indicates transfer failure, and a portion of the curves steeply descending to the right indicates re-transfer (back-transfer). Therefore, whether or not the second voltage applied is appropriate can be decided by the portion of the curves substantially parallel to the horizontal axis of the graphs in FIG. 20 through FIG. 22.

Specifically, in the sheet of 90 g/m$^2$ in FIG. 20, it can be seen that a second voltage in a range of 600 V to 1600 V, except the portion ascending and descending to the right, is appropriate. Here, the second voltage of +600 V applied in accordance with the control of the CPU 47 for the recording sheet 6 of group 5 falls in this range. Thus, it can be said that the control by the CPU 47 is appropriate.

Similarly, in the sheet of 128 g/m$^2$ in FIG. 21, a second voltage in a range of 1000 V to 1500 V, except the portion ascending and descending to the right, is appropriate. Here, the second voltage of +1000 V applied in accordance with the control of the CPU 47 for the recording sheet 6 of group 4 falls in this range. Thus, it can be said that the control by the CPU 47 is appropriate.

Also, in the sheet of 184 g/m$^2$ in FIG. 22, a second voltage in a range of 1000 V to 1600 V, except the portion ascending and descending to the right, is appropriate. Here, the second voltage of +1300 V applied in accordance with the control of the CPU 47 for the recording sheet 6 of group 3 falls in this range. Thus, it can be said that the control by the CPU 47 is appropriate.

Therefore, the second voltage applied by the control of the CPU 47 is in accordance with the sheet type of the recording sheet 6, and is overall appropriate. Further, in the described voltage control, a desirable transfer is obtained regardless of the number of toner layers.

Note that, the values of second voltage given above are just one example and are not limited to those. This is also true for the first, third, and fourth voltages. Also, the second voltage may be controlled in steps other than the described 5 steps.

In this manner, in accordance with a detection signal from the sheet type detecting section 36, a low transfer voltage is set when the recording sheet 6 is thin, and a high transfer voltage is set when the recording sheet 6 is thick or is an OHP film. Thus, the problem of transfer failure and re-transfer is prevented regardless of the type (transparency and thickness) of the recording sheet 6. As a result, it is possible to prevent, lowering of printing quality as caused by different types of the recording sheet 6 used.

Note that, in the present embodiment, the second voltage is divided into a plurality of steps in accordance with the groups to which the recording sheet 6 belongs. However, it is possible alternatively to have an arrangement wherein, for example, the transmittance and corresponding basis weight of the recording sheet 6 are stored in a memory (not shown), and a control is carried out so that a second voltage corresponding to each basis weight is applied to the transfer roller 23.

In this case, as shown by the solid line $b_2$ in FIG. 19, the second voltage can be adjusted without steps, corresponding to each basis weight. Thus, even though satisfactory transfer can be obtained by the described step-control, with the non-step control, it is ensured that a desirable image in accordance with the sheet type of the recording sheet 6 is obtained, thus preventing lowering of the printing quality with certainty.

The fixing temperature control operates in the same manner as the transfer voltage control. That is, in accordance with a detection signal from the sheet type detecting section 36, a low fixing temperature is set when the recording sheet 6 is thin, and a high fixing temperature is set when the recording sheet 6 is thick or is an OHP film. As a result, an optimum fixing temperature is obtained in accordance with the type of the recording sheet 6, thus preventing the high temperature/low temperature offset when fixing a color toner image, regardless of the type of the recording sheet 6 used.

The transport speed control of the recording sheet 6 and the image forming rate control also operate in the same manner as the transfer voltage control. That is, in accordance with a detection signal from the sheet type detecting section 36, a slow transport speed and a slow image forming rate are set when the recording sheet 6 is thin, and a high transport speed and a high image forming rate are set when the recording sheet 6 is thick or is an OHP film, thus obtaining the described effect of the present embodiment.

The following describes the fixing temperature control by the fixing section 5 in detail.

The fixing belt 43 of the fixing section 5 has already been maintained at a set temperature by the ON/OFF control of the heater lamp 40*a* when the recording sheet 6 is transported to the fixing section 5. The ON/OFF control of the heater lamp 40*a* is carried out in accordance with the result of comparison between the length of the recording sheet 6 as detected by the sheet type detecting section 36 and the periphery of the fixing belt 43.

Figure 23:
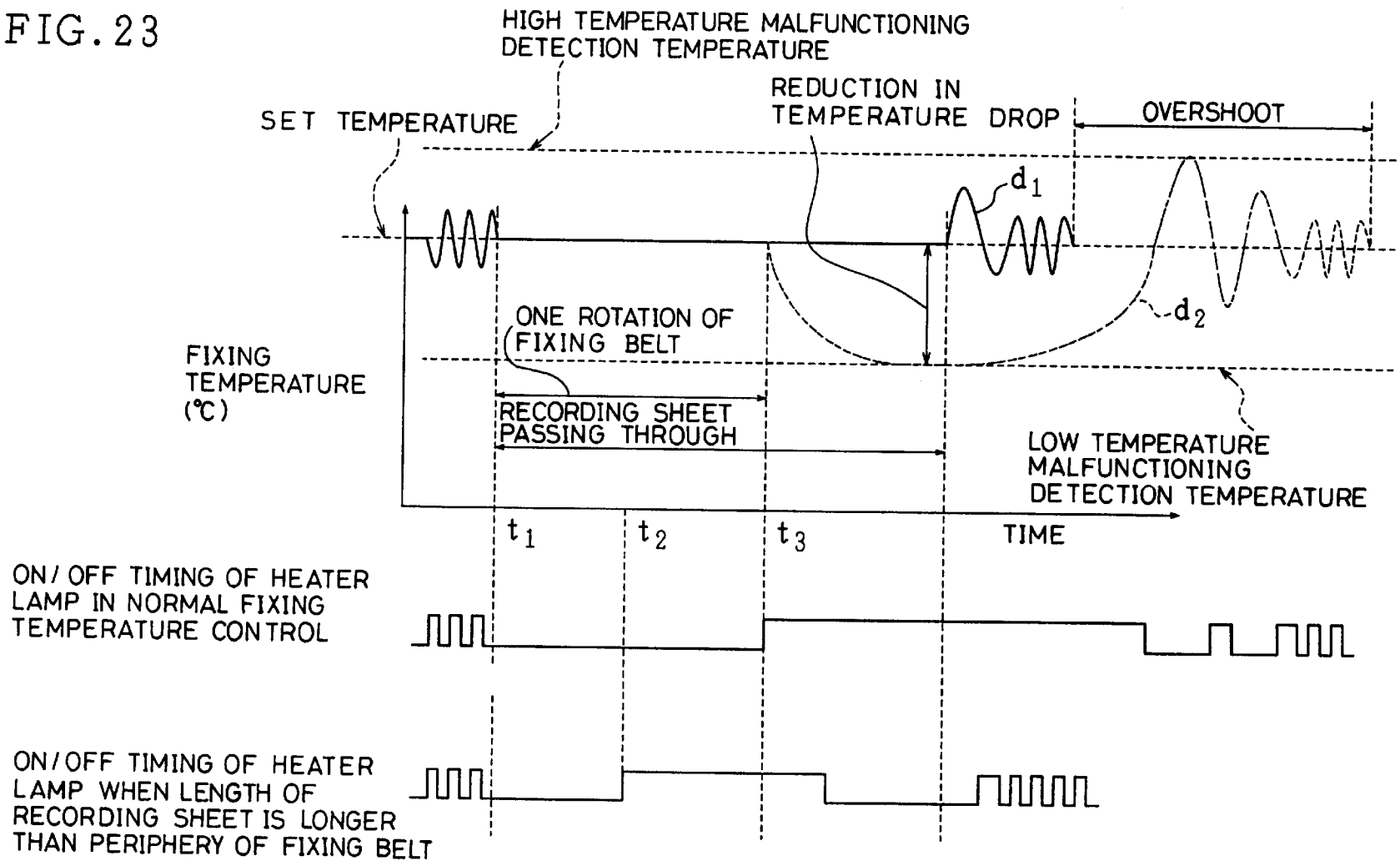
FIG. 23 is an explanatory drawing showing in logical representation a change in temperature by a fixing temperature control and ON/OFF timing of a heater lamp in the image forming apparatus.

To describe in more detail, as shown in FIG. 23, when the time the recording sheet 6 is brought into contact with the fixing belt 43 is t1, and when the time the fixing belt 43 completes one rotation from the time the recording sheet 6 is brought into contact with the fixing belt 43 is t 3, the CPU 47 controls the heater lamp 40*a*, when deciding that the length of the recording sheet 6 is longer than the periphery of the fixing belt 43, in such a manner that the heater lamp 40*a* is turned on at any instant between t1 and t3. Note that, when the time the heater lamp 40 a is turned on is t2, the period of t2 to t3 is longer than the time required for conduction of heat from the heater lamp 40*a* to the fixing belt 43.

On the other hand, when the CPU 47 decides that the length of the recording sheet 6 is shorter than the periphery of the fixing belt 43, a normal fixing temperature control is carried out. The normal fixing temperature control is the control wherein, during the period of t1 to t3, the surface temperature of the fixing belt 43 is maintained at the set temperature by the ON/OFF control of the heater lamp 40*a*, and after t3, while the heater lamp 40*a* is turned on when the surface temperature drops below the set temperature so as to avoid malfunctioning due to low temperature, the heater lamp 40*a* is turned off when the surface temperature exceeds the set temperature so as to avoid malfunctioning due to high temperature.

Note that, in FIG. 23, the time scale is different when overshoot is observed and when it is not observed. The overshoot is a phenomenon in which the surface temperature of the fixing belt 43 fluctuates from the set temperature by the ON/OFF control of the heater lamp 40*a*.

Figure 24:
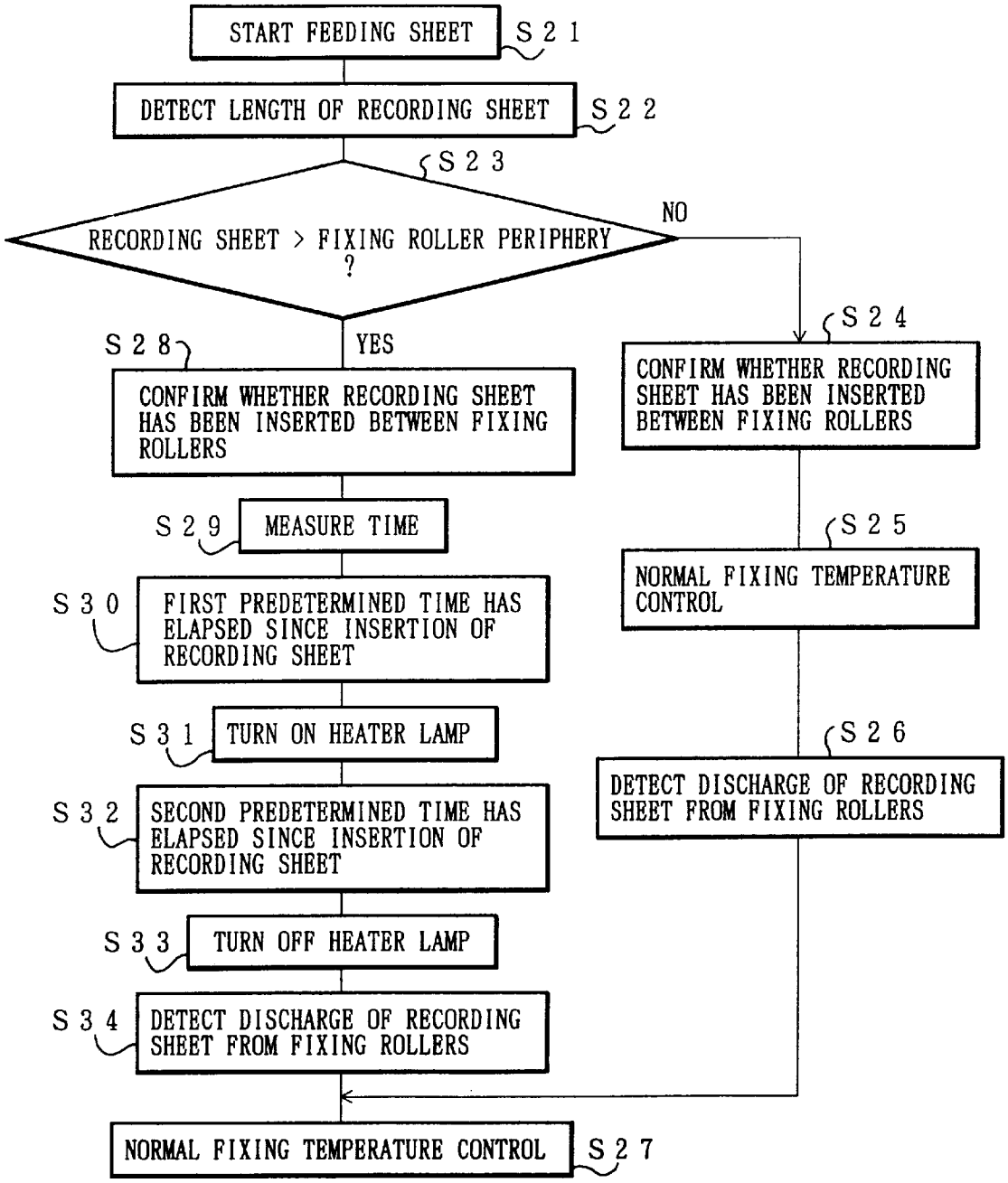
FIG. 24 is a flowchart showing an operation of the fixing temperature control.

The following describes an operation of such fixing control by the CPU 47 referring to the flowchart of FIG. 24.

First, when feeding of the recording sheet 6 is started (S21), the sheet type detecting section 36 detects the length of the recording sheet 6 (S21). In the case of automatic feeding from the sheet feeding cassette 31, the CPU 47 detects the type of the sheet feeding cassette 31 at the time when the feeding has started and also detects the length of the recording sheet 6, and thereafter the sequence goes to S23.

Then, the CPU 47 decides whether the length of the recording sheet 6 is longer than the periphery of the fixing belt 43 (S23). When it is decided that the length of the recording sheet 6 is shorter than the periphery of the fixing belt 43 in S23, the CPU 47 decides whether the recording sheet 6 has been inserted between the fixing rollers 39*a* and 39*b* (S24), and carries out the normal fixing temperature control in the described manner (S25).

Note that, the decision as to whether the recording sheet 6 has been inserted between the fixing rollers 39*a* and 39*b* can be made by deciding whether, for example, a particular transport time of the recording sheet 6 from the aligning rollers 37 to the fixing rollers 39*a* and 39*b* has been elapsed, which is stored beforehand in a memory (not shown). Alternatively, the decision may be made by providing a sensor, which detects the insertion of the recording sheet 6, in the vicinity of the fixing rollers 39*a* and 39*b*.

Thereafter, in S25, under the normal fixing temperature control, a color toner image is fixed on the recording sheet 6, and when a sheet sensor 42 detects that the recording sheet 6 has been discharged from the fixing rollers 39*a* and 39*b* (S26), the CPU 47 again carries out the normal fixing temperature control (S27).

Note that, in S26, discharge of the recording sheet 6 from the fixing rollers 39*a* and 39*b* may be detected based on the length of the recording sheet 6 as detected by the sheet type detecting section 36, the transport distance between the aligning rollers 37 and the fixing rollers 39*a* and 39*b*, and the rotational speed of the fixing rollers 39*a* and 39*b*. In this case, the sheet sensor 42 is not required.

On the other hand, when it is decided by the CPU 47 in S23 that the length of the recording sheet 6 is longer than the periphery of the fixing belt 43, after confirming in the described manner that the recording sheet 6 has been inserted between the fixing rollers 39*a* and 39*b* (S28), the CPU 47 starts measuring time from the time of insertion (time t1) (S29). At time t2 after the first predetermined time has elapsed (S30), the CPU 47 carries out a control of turning on the heater lamp 40*a* (S31). Therefore, the first predetermined time is the time between t1 and t2, and the time t2 is the time which is set in such a manner that the remaining period of t2 to t3 becomes longer than the time required for transfer of heat from the heater lamp 40*a* to the fixing belt 43. This ensures that the heat of the heater lamp 40*a* reaches the fixing belt 43 by t3, at the latest, at which the fixing belt 43 completes one rotation, thus suppressing the temperature drop of the fixing belt 43.

Then, after a second predetermined time has elapsed from the time of insertion (S32), the CPU 47 carries out a control of turning off the heater lamp 40*a* (S33). Note that, the second predetermined time is the period from time t1 as a reference point to any point between time t3 and the time the rear end of the recording sheet 6 is discharged from the fixing rollers 39*a* and 39*b*.

Thereafter, when the sheet sensor 42 detects that the recording sheet 6 has been discharged from the fixing rollers 39*a* and 39*b* (S34), the CPU 47 carries out again the normal fixing temperature control (S27)

When the fixing temperature control is carried out in the described manner, the surface temperature of the fixing belt 43 should theoretically take the form of the curve d1 as shown in FIG. 23. In this case, even when the length of the recording sheet 6 is longer than the periphery of the fixing belt 43, unlike the conventional case as indicated by the curve d2, the surface temperature of the fixing belt 43 does not drop while the toner image is still being fixed to the recording sheet 6. Therefore, the recording sheet 6 is uniformly fixed from the front end to rear end, and uniform glossiness and transparency are obtained. This effect is especially prominent in color images. Also, in the present embodiment, the surface temperature of the fixing belt 43 is nearly the set temperature immediately after the recording sheet 6 is discharged, allowing an easy start of the next fixing operation for the recording sheet 6.

Figure 25:
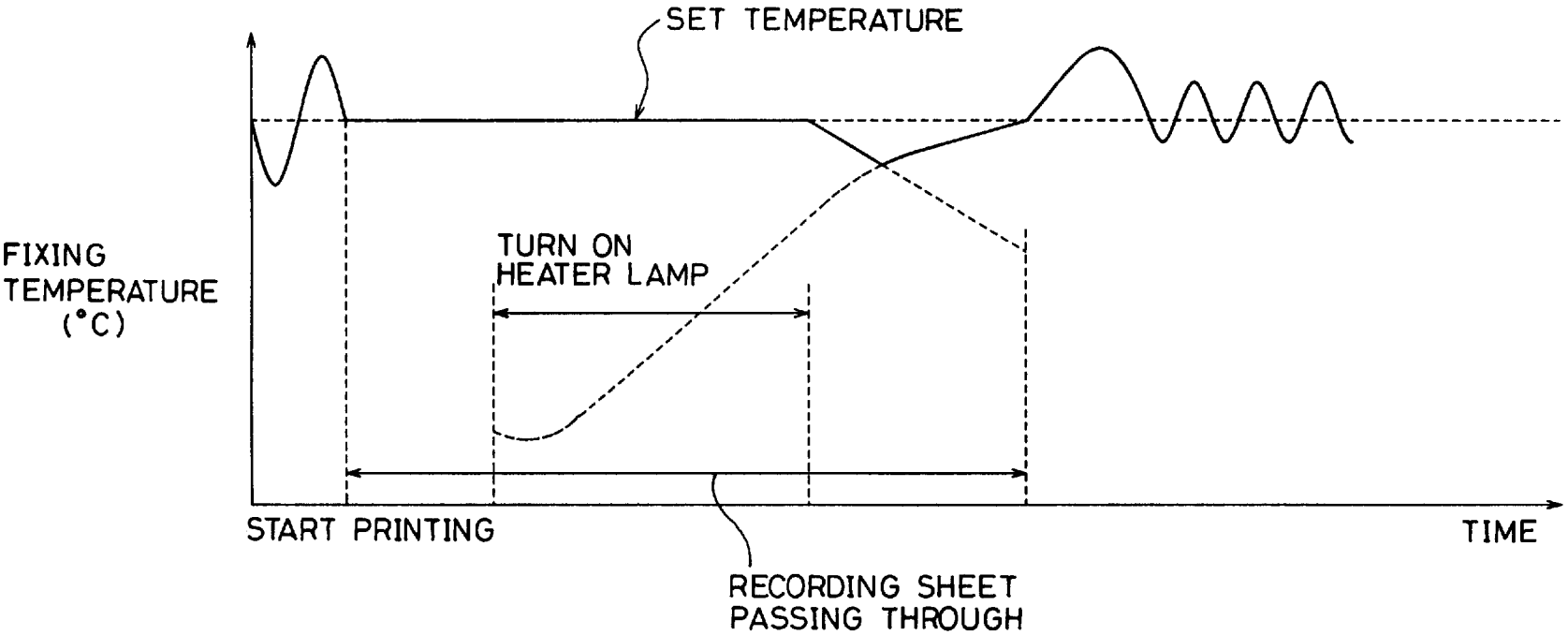
FIG. 25 is an explanatory drawing showing an actual change in fixing temperature in the image forming apparatus.
Figure 30:
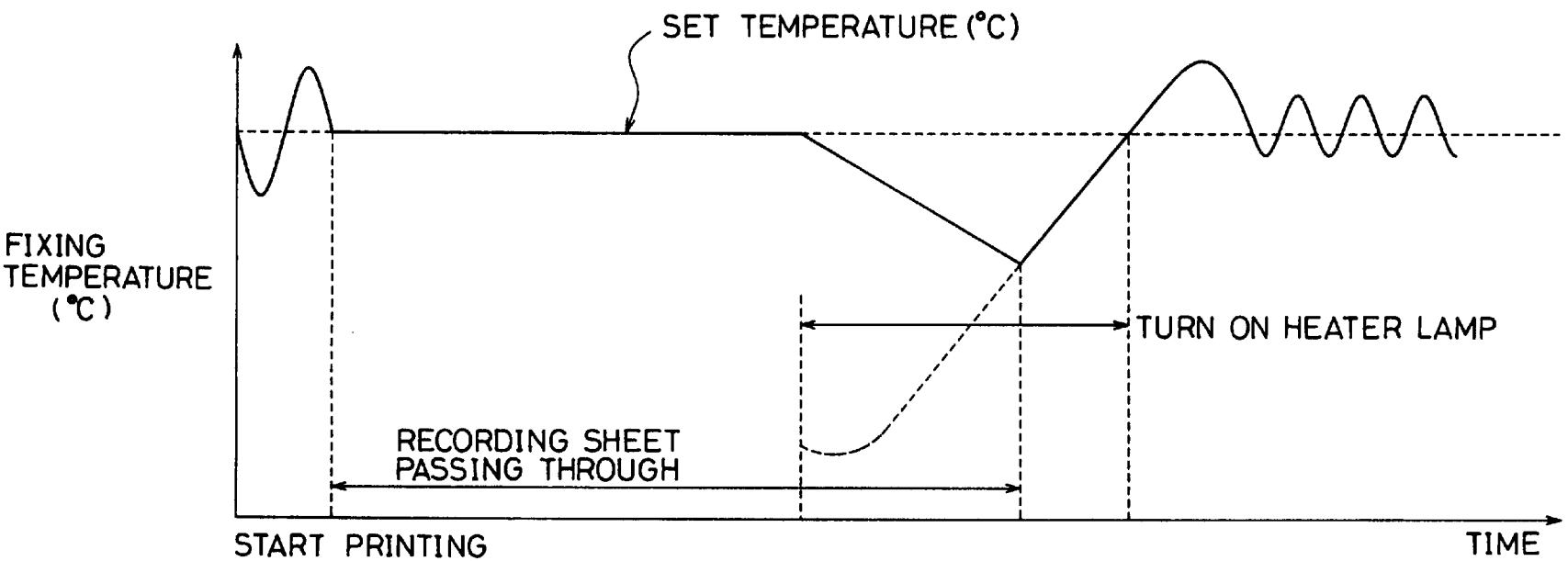
FIG. 30 is an explanatory drawing showing an actual change in fixing temperature in the conventional image forming apparatus.

In reality, however, as shown in FIG. 25, the surface temperature of the fixing belt 43 drops slightly after one rotation of the fixing belt 43. Nevertheless, compared with the conventional case as shown in FIG. 30, a decrease in the surface temperature while fixing the recording sheet 6 is significantly reduced, thus realizing substantially uniform fixing ability from the front end to the rear end of the recording sheet 6.

Figure 26:
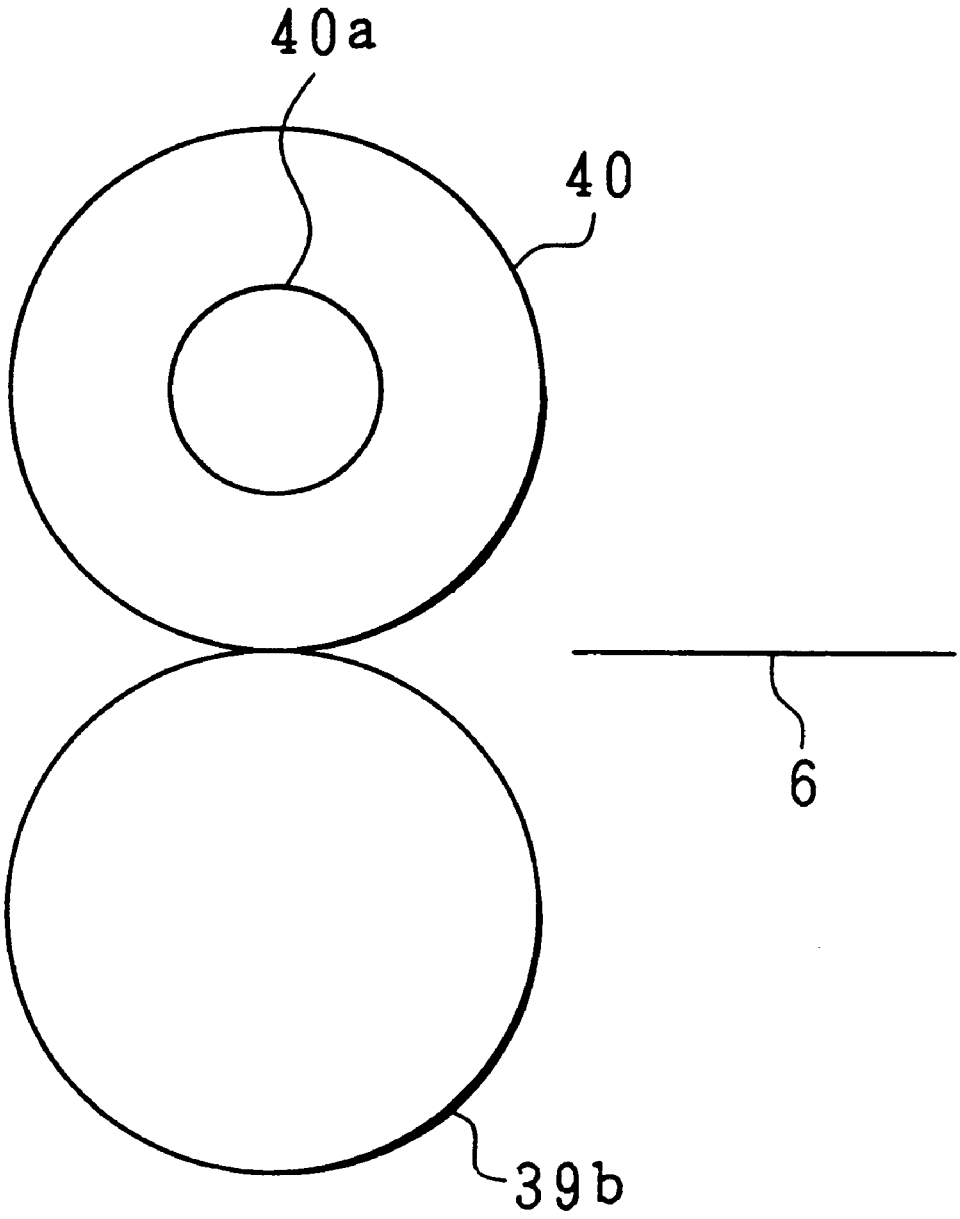
FIG. 26 is a cross sectional view showing a fixing roller as another example of fixing means in the image forming apparatus.
Figure 27:
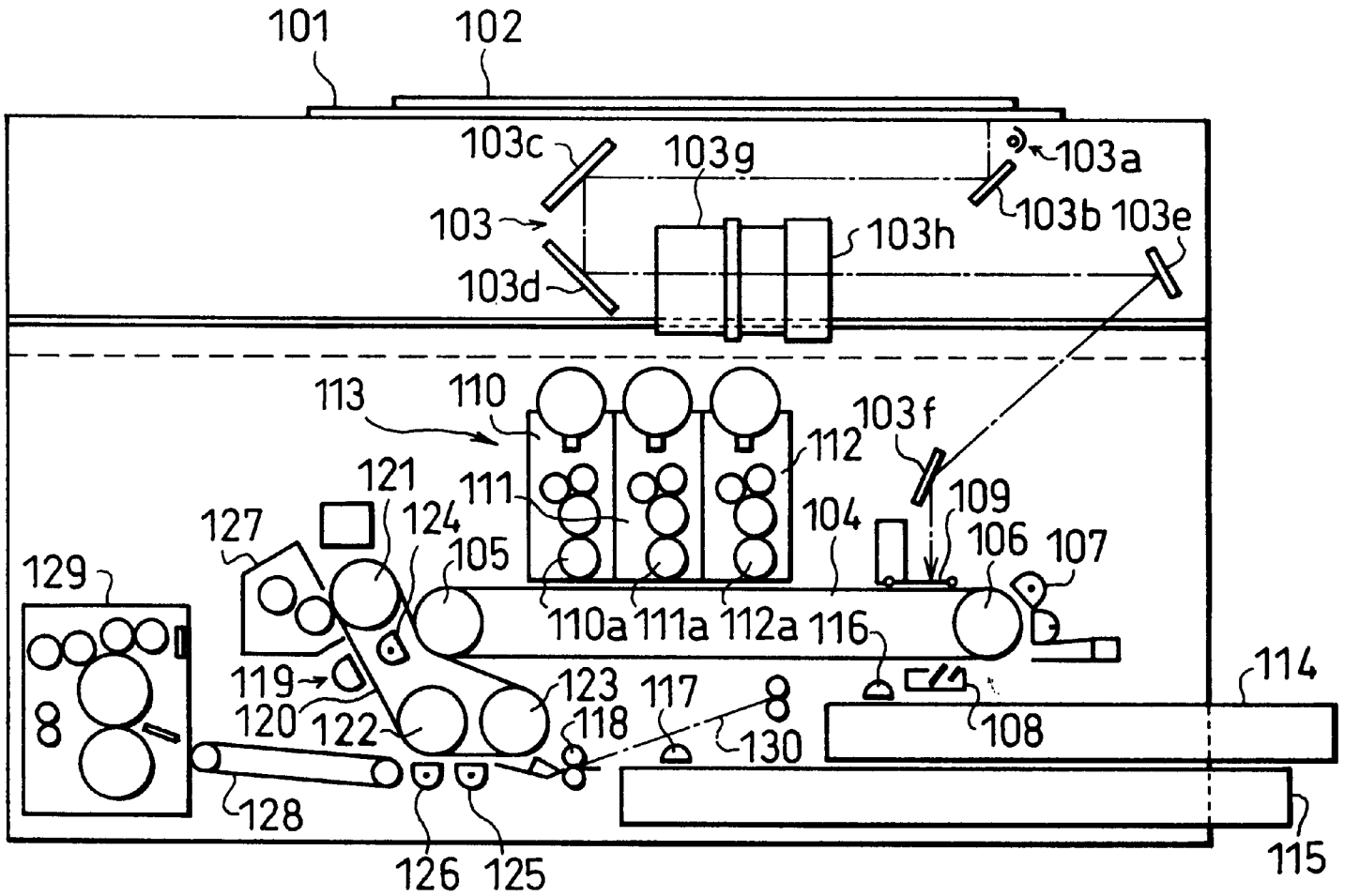
FIG. 27 is a cross sectional view showing a schematic arrangement of a conventional image forming apparatus.
Figure 28:
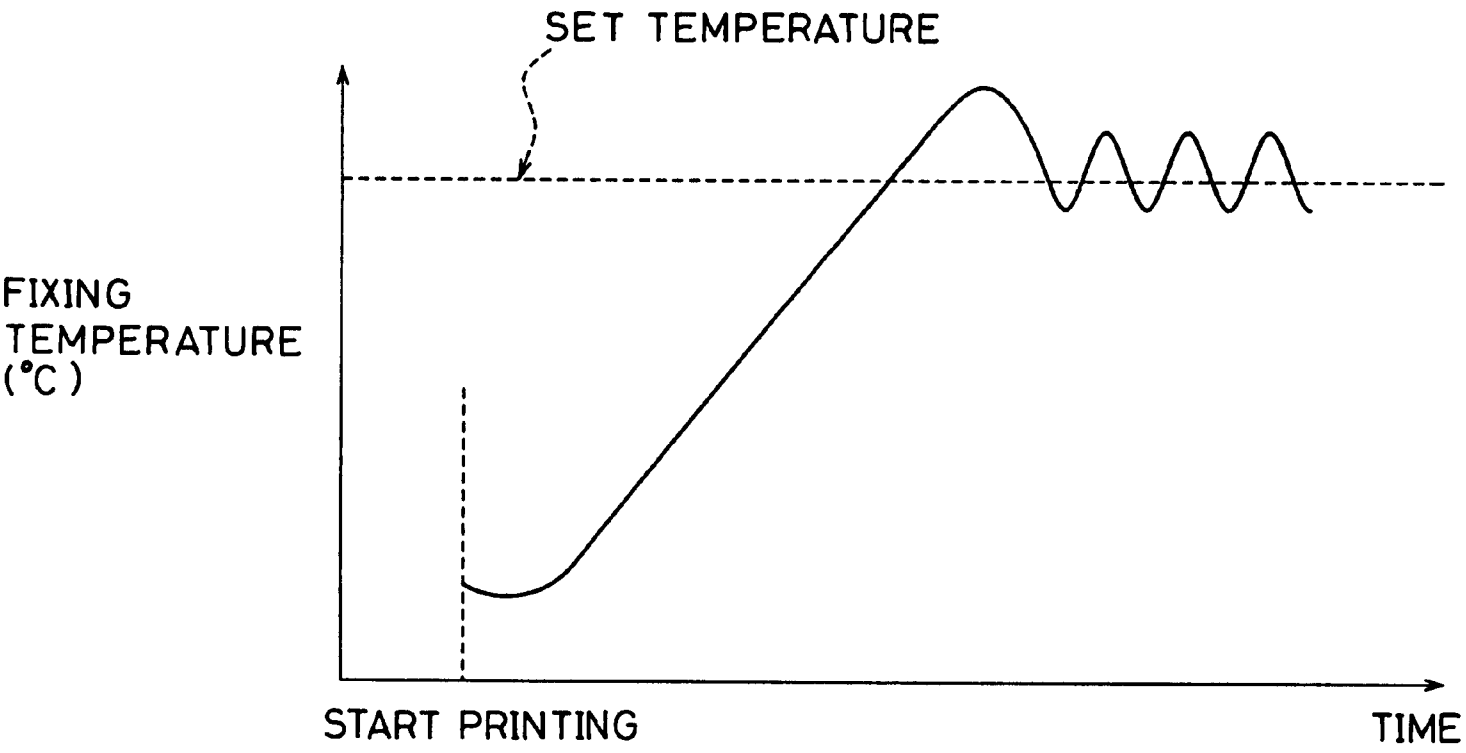
Figure 29:
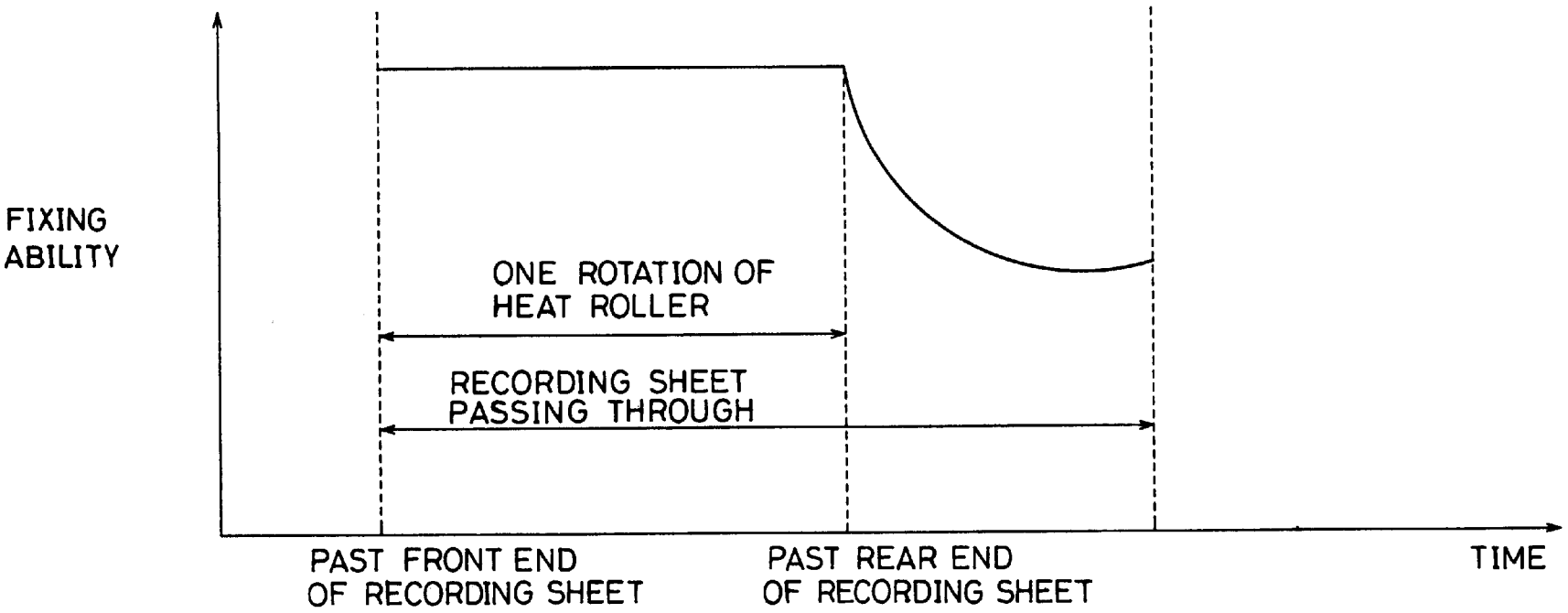
FIG. 29 is an explanatory drawing showing a change in fixing ability with time.

In the present embodiment, the recording sheet 6 is fixed using the fixing belt 43 suspended by the fixing roller 39*a* and the heat roller 40. However, the same effect as obtained in the present embodiment can also be obtained in the arrangement, as shown in FIG. 26, wherein fixing is carried out by sandwitching the transported recording sheet 6 by the heat roller 40 and the fixing roller 39*b* without using the fixing belt 43. In this case, the heat roller 40 constitutes the fixing means, and the periphery of the fixing belt 43 as described above corresponds to the periphery of the heat roller 40.

After the length of the recording sheet 6 is detected by the sheet type detecting section 36, the CPU 47 may carry out a control of changing the speed of each transfer step, the transport speed of the recording sheet 6, and the set temperature of fixing, etc., based on the length and thickness, etc., of the recording sheet 6. For example, when the length of the recording sheet 6 is long, the CPU 47 carries out a control of slowing down the transport speed of the recording sheet 6. This takes care of the case where the conduction speed of the heat to the fixing belt 43 is slow, and as a result uniform fixing ability is maintained from the front end to the rear end of the recording sheet 6.

After fixing of the recording sheet 6 is finished, the CPU 47 can carry out a control of automatically bringing the surface temperature of the fixing belt 43 back to the set temperature before the recording sheet 6 has passed through. This allows the surface temperature of the fixing belt 43 to return to the set temperature more quickly, allowing the next fixing operation for the recording sheet 6 to be started immediately. Also, in this case, the overshoot as described above is prevented, thus preventing the surface temperature of the fixing belt 43 from increasing excessively. As a result, deterioration of the fixing belt 43 due to high temperature is prevented, thus protecting the fixing belt 43. Here, the CPU 47 constitutes a fixing belt safe circuit.

The CPU 47 constituting such a fixing belt safe circuit turns off the heater lamp 40*a* when it is detected by the fixing temperature sensor 41, when the recording sheet 6 is passing through the fixing belt 43, when carrying out plural successive printing, or after the recording sheet 6 has passed through the fixing belt 43, that the fixing temperature is exceeding the temperature range which can be controlled. Thereafter, the CPU 47 turns on the heater lamp 40*a* so as to bring the surface temperature of the fixing belt 43 back to the set temperature before the recording sheet 6 has passed through. This protects the fixing belt 43 when carrying out plural successive printing, and ensures proper fixing ability after returning to the set temperature.

Note that, the same effects as obtained in the present embodiment can be obtained even in the case where the photoreceptor 7 is composed of a drum and the intermediate transfer medium 22 is composed of a belt. Also, in the present embodiment, even though the explanations were given through the case of full-color printing, the same effects can be obtained in twin-color printing and mono-color printing.

The image forming apparatus of the present invention may have an arrangement wherein the transfer device is brought into contact with the intermediate transfer medium in (i) the first stage before visualization of a first color is started, (ii) the second stage for carrying out the second transfer, and (iii) the third stage for carrying out the third transfer for transferring a developer adhering on the transfer medium to the intermediate transfer medium and the fourth transfer for transferring a developer adhering on the intermediate transfer medium to the latent image holding device, and the transfer device applies a voltage in accordance with each of the first, second, and third stages.

With this arrangement, the transfer device is brought into contact with the intermediate transfer medium only in the above stages which are required for printing, instead of contacting with the intermediate transfer medium all the time. Therefore, it is possible to prevent filming from generating on the surface of the intermediate transfer medium, and the visualized image from being transferred to the transfer device by pressure. As a result, disturbance on the visualized image transferred to the recording medium is prevented and it is ensured that the printing quality is improved. Note that, filming is a phenomenon in which the developer sticks to the intermediate transfer medium by being stretched over at the contact between the transfer device and the intermediate transfer medium as a result of continuous contact between these two members.

Further, with the described arrangement, the transfer device applies a voltage to the intermediate transfer medium in accordance with each of the first, second, and third stages, thus ensuring that transfer efficiency is improved in each of these stages.

The image forming apparatus of the present invention may have an arrangement wherein the first voltage applied in the first stage and the second voltage applied in the second stage both have the opposite polarity to that of the developer, and the second voltage has a larger absolute value than that of the first voltage.

With this arrangement, it is ensured that the visualized image on the intermediate transfer medium is second-transferred to the recording medium.

The image forming apparatus of the present invention may have an arrangement wherein the third voltage, corresponding to the third transfer, applied in the third stage is the voltage that is shifted to the side of the polarity of the developer from the second voltage applied in the second stage, and the fourth voltage, corresponding to the fourth transfer, applied in the third stage is the voltage that is shifted to the side of the polarity of the developer from the third voltage, corresponding to the third transfer, applied in the third stage.

With this arrangement, it is ensured that unnecessary developer adhering on the transfer device is transferred back to the intermediate transfer medium, and back to the latent image holding device from the intermediate transfer medium.

The image forming apparatus of the present invention may have an arrangement wherein the third voltage, corresponding to the third transfer, applied in the third stage is equal to the fourth voltage, corresponding to the fourth transfer, applied in the third stage.

With this arrangement, it is ensured that unnecessary developer adhering on the transfer device and on the intermediate transfer medium is transferred back to the latent image holding device simultaneously.

The image forming apparatus of the present invention may have an arrangement wherein, in the first stage and the third stage, the voltage applying device applies a predetermined voltage to the transfer device for a duration longer than one rotation of the intermediate transfer medium.

With this arrangement, the surface of the intermediate transfer medium is uniformly charged, allowing, in the first stage, a uniform first transfer of the visualized image on the latent image holding device to the intermediate transfer medium, from the front end to the rear end. Also, in the third stage, it is possible to uniformly clean the surfaces of the transfer device and the intermediate transfer medium.

The image forming apparatus of the present invention may have an arrangement wherein, in the first stage, the transfer device is separated from the intermediate transfer medium after a predetermined voltage is applied by the voltage applying device and before visualization of the first color is started.

With this arrangement, it is possible to prevent the visualized image first-transferred to the intermediate transfer medium from being disturbed by the transfer device brought into contact with the intermediate transfer medium.

The image forming apparatus of the present invention may have an arrangement wherein the transfer device is kept separated from the intermediate transfer medium in the duration between the first stage and the second stage.

With this arrangement, it is possible to prevent the visualized image first-transferred to and overlapped on the intermediate transfer medium from being disturbed by the transfer device brought into contact with the intermediate transfer medium.

The image forming apparatus of the present invention may have an arrangement wherein, in the second stage, the transfer device is brought into contact with the intermediate transfer medium at a timing when the front end of the visualized image on the intermediate transfer medium coincides with the front end of the recording medium transported between the transfer device and the intermediate transfer medium.

With this arrangement, the front end of the visualized image on the intermediate transfer medium coincides with the front end of the recording medium, thus allowing second transfer of the visualized image to the recording medium without disturbance.

The image forming apparatus of the present invention may have an arrangement wherein, in the third stage, the transfer device carries out the third transfer and the fourth transfer while being in contact with the intermediate transfer medium.

With this arrangement, the transition from the third transfer to the fourth transfer is made without separating the transfer medium from the intermediate transfer medium, thus simplifying the control operation of contact and separation of the transfer device.

The image forming apparatus of the present invention may have an arrangement wherein the transfer device is separated from the intermediate transfer medium after the fourth transfer in the third stage.

With this arrangement, it is possible to prevent deformation of the transfer device and the intermediate transfer medium, as caused by the transfer device pressing the intermediate transfer medium. As a result, it is ensured that the visualized image first-transferred to the intermediate transfer medium is prevented from being disturbed.

The image forming apparatus of the present invention may have an arrangement wherein the intermediate transfer medium is composed of an integral unit of a metal drum and a semiconductive resin film.

With this arrangement, since the intermediate transfer medium is a drum unit, compared with the case where the intermediate transfer medium is composed of a belt and a plurality of suspension rollers, the number of components can be reduced, and it is possible to reduce the overall costs.

Further, by the integral unit of the metal drum and the semiconductive resin film, it is ensured that the voltage applied via the transfer device is maintained by the semiconductive resin film, and that discharge is carried out when it is required, thus ensuring efficient transfers.

In order to achieve the above-mentioned objects, the image forming apparatus of the present invention includes the latent image holding device for holding color-separated image information as an electrostatic latent image; the plurality of developing device for making the electrostatic latent image held by the latent image holding device visible color by color; the intermediate transfer medium on which a visualized image of each color visualized on a surface of the latent image holding device is overlapped upon contact with the latent image holding device; the transfer device, which is separable and contactable with respect to the intermediate transfer medium; and the voltage applying device for applying a predetermined voltage to the transfer device, and the image forming apparatus of the present invention may further include the cleaning device for removing altogether a developer transferred from the transfer device to the intermediate transfer medium and a developer transferred from the intermediate transfer medium to the latent image holding device, by the contact between the transfer device and the intermediate transfer medium, and by application of the predetermined voltage from the voltage applying device to the transfer device, so as to clean the surface of the latent image holding device.

With this arrangement, the electrostatic latent image formed on the latent image holding device is made visible by the developer of corresponding color. A plurality of visualized images obtained by the plurality of developing devices are overlapped with one another on the intermediate transfer medium, and thereafter are transferred onto the recording medium from the intermediate transfer medium by the application of a voltage from the voltage applying device to the transfer device.

Here, a developer transferred to the intermediate transfer medium from the transfer device and a developer transferred to the latent image holding device from the intermediate transfer medium are removed altogether by a single cleaning device, and therefore it is not required to provide separate device for cleaning the transfer means and the intermediate transfer medium.

As a result, the number of cleaning device can be reduced, thus making the device compact and reducing the cost of the device.

The image forming apparatus of the present invention includes the latent image holding device for holding color-separated image information as an electrostatic latent image; the plurality of developing device for making the electrostatic latent image held by the latent image holding device visible color by color; the intermediate transfer medium on which a visualized image of each color visualized on a surface of the latent image holding device is overlapped upon contact with the latent image holding device; the transfer device for transferring the overlapped visualized image from the intermediate transfer medium to the recording medium; and the voltage applying device for applying a predetermined voltage to the transfer device, and the image forming apparatus of the present invention may further include the sheet type detecting device for detecting the type of the recording medium; and the control device for controlling an image forming operation in accordance with a detection signal from the sheet type detecting device.

With this arrangement, the electrostatic latent image formed on the latent image holding device is made visible by the developer of corresponding color. A plurality of visualized images obtained by the plurality of developing device are overlapped with one another on the intermediate transfer medium, and thereafter are transferred onto the recording medium from the intermediate transfer medium by the application of voltage from the voltage applying device to the transfer device.

Here, the control device controls the image forming operation in accordance with a detection signal from the sheet type detecting section. For example, the control device carries out a control of increasing, for example, a transfer voltage applied to the transfer device when the recording medium is thick, and carries out a control of reducing the transfer voltage when the recording medium is thin. As a result, it is possible to obtain desirable transfer characteristics regardless of the thickness of the recording medium used.

Therefore, when the control device controls, in addition to the transfer voltage control, various parameters of image formation, such as transport speed of the recording medium, the fixing temperature, and the development bias voltage, in accordance with the type of the recording medium, it is possible to carry out a desirable image forming operation in accordance with the recording medium.

The image forming apparatus of the present invention includes the latent image holding device for holding color-separated image information as an electrostatic latent image; the plurality of developing devices for making the electrostatic latent image held by the latent image holding device visible color by color; the intermediate transfer medium on which a visualized image of each color visualized on a surface of the latent image holding device is overlapped upon contact with the latent image holding device; the transfer device for transferring the overlapped visualized image from the intermediate transfer medium to the recording medium; the fixing device, which is rotatable, for fixing an unfixed visualized image transferred on the recording medium; and heating device for heating the fixing device so that a surface temperature of the fixing device becomes a predetermined temperature, and the image forming apparatus of the present invention may further include the sheet type detecting section for detecting the type of the recording medium; and the fixing temperature control device for controlling the on-and-off state of the heating device in accordance with the type of the recording medium, wherein the fixing temperature control device carries out a control, when the length of the recording medium detected by the sheet type detecting device is longer than the periphery of the fixing device, so that the heating device is turned on in advance at any instant between the time when the recording medium is brought into contact with the fixing device and the time when the fixing device completes one rotation, taking into consideration the time required for conduction of heat from the heating device to the fixing device.

With this arrangement, the electrostatic latent image formed on the latent image holding device is made visible by the developer of corresponding color. A plurality of visualized images obtained by the plurality of developing devices are overlapped with one another on the intermediate transfer medium, and thereafter are transferred onto the recording medium from the intermediate transfer medium. The unfixed visualized image on the recording medium is fixed on the recording medium by the rotation of the fixing device heated by the heating device. Note that, the sheet type detecting devices detects, for example, the length of the recording medium.

Incidentally, the heat of the fixing device is given off to the recording medium or to the unfixed developer in one rotation of the fixing device. For this reason, in the case where the recording medium is longer than the periphery of the fixing device, while the fixing ability is stable on the recording medium from the front end to the point in length corresponding to the periphery of the fixing device, the fixing ability abruptly decreases from the point past the periphery of the fixing device to the rear end of the recording medium.

However, in the described arrangement, the heating device is turned on in advance at any instant between the time when the recording medium is brought into contact with the fixing device and the time when the fixing device completes one rotation, taking into consideration the time required for conduction of heat from the heating device to the fixing device. With this arrangement, the surface temperature of the fixing device does not drop while the unfixed image is still being fixed to the recording medium, thus preventing lowering of fixing ability.

Therefore, the recording medium is uniformly fixed from the front end to rear end, and uniform glossiness and transparency are obtained. This effect is especially prominent in color images.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

latent image holding means for holding color-separated image information as an electrostatic latent image;

a plurality of developing means for making the electrostatic latent image held by said latent image holding means visible color by color;

an intermediate transfer medium to which a visualized image of each color visualized on a surface of said latent image holding means is successively transferred upon contact with said latent image holding means;

transfer means for transferring the visualized image successively transferred onto said intermediate transfer medium to the recording medium; and voltage applying means for applying a predetermined voltage to said transfer means, said image forming apparatus further comprising:

sheet type detecting means for detecting a type of the recording medium; and control means for controlling a parameter associated with an image forming operation in accordance with a detection signal from said sheet type detecting means, said sheet type detecting means including transmission detecting means for detecting light transmitted through the recording medium and reflection detecting means for detecting light reflected off a surface of the recording medium;

a wavelength of light projected on the recording medium for detection by the transmission detecting means being set such that a characteristic of transmittance against wavelength is sorted out in accordance with a mass per unit area of the recording medium.

2. The image forming apparatus as set forth in claim 1, wherein the parameter is the predetermined voltage applied to said transfer means.

3. The image forming apparatus as set forth in claim 1, wherein the parameter is a transport speed of the recording medium.

4. The image forming apparatus as set forth in claim 1, wherein the parameter is a fixing temperature of fixing an unfixed visualized image transferred on the recording medium.

5. The image forming apparatus as set forth in claim 1, wherein the parameter is a development bias voltage.

6. The image forming apparatus as set forth in claim 1, wherein the parameter is an image forming rate.

7. The image forming apparatus as set forth in claim 1, wherein the parameter is a voltage for charging said latent image holding means.

8. The image forming apparatus as set forth in claim 1, wherein the parameter is a voltage of a power source for applying a voltage to a sheet removal charger which removes the recording medium from said intermediate transfer medium.

9. The image forming apparatus as set forth in claim 1, wherein the type of the recording medium detected by said sheet type detecting means is at least one kind selected from the group consisting of transparency, thickness, length, and color.

10. The image forming apparatus as set forth in claim 1, further comprising:

fixing means, which is rotatable, for fixing an unfixed visualized image transferred on the recording medium;

heating means for heating said fixing means so that a surface temperature of said fixing means becomes a predetermined temperature; and fixing temperature control means for controlling an on-and-off state of said heating means in accordance with a type of the recording medium, wherein said fixing temperature control means carries out a control, when a length of the recording medium detected by said sheet type detecting means is longer than a periphery of said fixing means, so that said heating means is turned on in advance at any instant between a time when the recording medium is brought into contact with said fixing means and a time when said fixing means completes one rotation, taking into consideration a time required for conduction of heat from said heating means to said fixing means.

* * * * *